United States Patent [19]

Watanabe et al.

[11] Patent Number: 4,746,600

[45] Date of Patent: May 24, 1988

[54] LIGHT-SENSITIVE SILVER HALIDE COLOR PHOTOGRAPHIC MATERIAL WITH NON-DIFFUSABLE LIGHT-INSENSITIVE DYE LAYER

[75] Inventors: Yoshikazu Watanabe; Hiroshi Shimazaki; Toshifumi Iijima; Yoshiro Shigetomi; Toshihiko Yagi, all of Hino, Japan

[73] Assignee: Konishiroku Photo Industry Co., Ltd., Tokyo, Japan

[21] Appl. No.: 879,147

[22] Filed: Jun. 26, 1986

[30] Foreign Application Priority Data

| | | | |
|---|---|---|---|
| Jul. 1, 1985 | [JP] | Japan | 60-145101 |
| Aug. 28, 1985 | [JP] | Japan | 60-188773 |
| Jan. 20, 1986 | [JP] | Japan | 61-9788 |

[51] Int. Cl.[4] ..... G03C 1/46; G03C 7/32; G03C 1/08; G03C 5/54

[52] U.S. Cl. ..... 430/505; 430/223; 430/544; 430/553; 430/555; 430/557; 430/558; 430/564; 430/955; 430/956; 430/957; 430/958; 430/959

[58] Field of Search ..... 430/505, 223, 955, 956, 430/957, 958, 959, 564, 544, 553, 555, 557, 558

[56] References Cited

U.S. PATENT DOCUMENTS

| | | | |
|---|---|---|---|
| 4,186,011 | 1/1980 | Lohmann et al. | 430/505 |
| 4,421,845 | 12/1983 | Uemura et al. | 430/555 |
| 4,546,073 | 10/1985 | Bergthaller et al. | 430/544 |
| 4,564,590 | 1/1986 | Sasaki et al. | 430/505 |

FOREIGN PATENT DOCUMENTS 2010818 7/1979 United Kingdom .

*Primary Examiner*—Mukund J. Shah

*Attorney, Agent, or Firm*—Frishauf, Holtz, Goodman & Woodward

[57] ABSTRACT

Disclosed is a light-sensitive silver halide color photographic material in which a DIR compound capable of releasing a diffusible development inhibitor or precursor thereof by the reaction with an oxidized form of a color developing agent is employed in combination with a non-diffusible dye and which sastisfies Condition A and B recited in the specification.

By using the color light-sensitive material according to the present invention, the sharpness, particularly the edge effect (including the fringe effect and the border effect) of a photographic image has been greatly improved.

27 Claims, No Drawings

LIGHT-SENSITIVE SILVER HALIDE COLOR PHOTOGRAPHIC MATERIAL WITH NON-DIFFUSABLE LIGHT-INSENSITIVE DYE LAYER

BACKGROUND OF THE INVENTION

This invention relates to a multilayer light-sensitive silver halide photographic material. More specifically, it relates to a multilayer light-sensitive silver halide color photographic material (herinafter referred to simply as "color light-sensitive material") in which sharpness and color reproducibiliy of an image have been improved.

Conventionally, the techniques for improving color reproducibility and sharpness by emphasizing an inter image effect (hereinafter referrd to as "I.I.E.") with the use of DIR couplers have been known, and various compounds are used as these DIR compounds. For example, there may be included the so-called DIR couplers which form color forming dyes through the oxidized product of a color developing agent simultaneously with release of a developing inhibitor during development, the so-called DIR substances which release a developing inhibitor through the reaction with the oxidized product of a color developing agent but do not form a color forming dye, those which can release directly or indirectly a developing inhibitor through the reaction with the oxidized product of a color developing agent as disclosed in Japanese Provisional Patent Publications (JAPAN KOKAI) No. 145135/1979, No. 154234/1982, No. 162949/1983, No. 205150/1983, No. 195643/1984, No. 206834/1984, No. 206836/1984, No. 210440/1984 and No. 7429/1985 (hereinafter called timing DIR compounds). In the present specification, those exhibiting the above DIR effect are called comprehensively as the DIR compounds.

When these DIR compounds are used in light-sensitive silver halide color materials, developing inhibitors can be released from DIR compounds during development to obtain the effect of inhibiting development in other silver halide emulsion layers, namely I.I.E. Particularly, DIR compounds capable of releasing the so-called diffusive inhibiting groups or diffusive developing inhibitor precursors are effective. They have been used for silver halide color films in these days to give some effects. However, due to strong directional tendency of I.E.E. (for example, strong in the direction from a blue-sensitive silver halide emulsion layer to a green-sensitive silver halide emulsion layer, but weak in the opposite direction), although improvement of saturation (chroma) of a specific color may be expected, an undesirable effect of "dislocation in hue" is accompanied therewith. Also, with respect to diffusiveness, since the inhibiting effect acts most strongly on the added layer, and therefore problems are involved such as lowering in gamma ($\gamma$), lowering in sensitivity, lowering in color formed density, etc. Thus, it is difficult to use an amount which can give sufficient effects to other layers.

The techniques for emphasizing I.I.E. from a color-sensitive layer to a different color-sensitive layer with the use of the so-called diffusible DIR compound are disclosed in Japanese Patent Publication (JAPAN KOKOKU) No. 47379/1980, Japanese Provisional Patent Publications (JAPAN KOKAI) No. 93344/1982, No. 56837/1982 and No. 131937/1984. Even by use of these techniques, only unsatisfactory improvement of color reproducibility can be expected under the present situation.

On the other hand, it has been known to improve sharpness of an image, when I.I.E. is created by use of the so-called diffusive DIR compound as disclosed in the above patent publications or specifications.

This is due to improvment of color contrast accompanied with I.I.E, which is the edge effect between layers in addition to the edge effect in the added layer.

However, the improvement in sharpness and color reproducibility by use of a DIR compound has not yet been made sufficiently.

SUMMARY OF THE INVENTION

An object of the present invention is to provide a color light-sensitive material having an improved edge effect and being excellent in sharpness and color reproducibility.

The present inventors have made extensive investigation on various materials, layer consitutions and the like including the above-mentioned technologies, and as the result they found that the object of the present invention can be attained by the following multilayer light-sensitive silver halide color photographic material: a light-sensitive silve halide color photographic material having, on a support, a red sensitive emulsion layer group and a green sensitive emulsion layer group constituted by at least two layers of which the color sensitivities are substantially the same and the light-sensitvities are different from each other, and a plural number of light-insensitive hydrophilic colloidal layers, which comprises a DIR compound capable of releasing a diffusible development inhibitor or a precursor thereof by the reaction with an oxidized form of a color developing agent (hereinafter referred to as "diffusible DIR compound") and satisfies at least one of the following Conditions A and B:

Condition A: to have at least one layer of said light-insensitive colloidal layers containing a non-diffusible red absorptive dye and being located at the position farther, when viewed from the support, than the red sensitive emulsion layer closest to the support among said red sensitive emulsion layer group Condition B: to have at least one layer of said light-insensitive hydrophilic colloidal layers containing a non-diffusible green absorptive dye and being located at the position farther, when viewed from the support, than the green sensitive emulsion layer closest to the support among said green sensitive emulsion layer group.

Conventionally, it has been known that sharpness can be improved by a DIR compond or that sharpness can be improved by using a dye. However, it has been unexpected at all to have found that particurarly the edge effect (fringe effect and border effect) can considerably be improved by using the diffusible DIR compound and the non-diffusible dye according to the present invention.

DESCRIPTION OF THE PREFERRED EMBODIMENTS

The DIR compounds to be used in the present invention which reacts with an oxidized form of a color developing agent to release a diffusible development inhibitor or a precursor thereof may be represented by the following general formula (1)

$A(Y)_m$ (1)

wherein A represents a coupler component; m is an integer of 1 or 2; and Y is a group which is bonded to the coupler component A at the coupling site of A and which will be eliminated by the reaction with an oxidized form of a color developing agent and represents a group which will become, after eliminated, a development inhibitor having higher diffusibility or a compound capable of releasing a development inhibitor.

A may possess a property of a coupler and not necessarily form any dye by a coupling reaction.

In general formula (1), Y may preferably represent the groups of the following general formulas (2A) to (5).

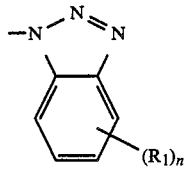
general formula (2A)

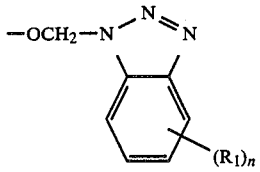
general formula (2B)

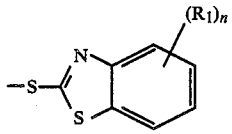
general formula (2C)

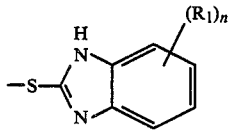
general formula (2D)

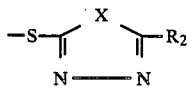
general formula (2E)

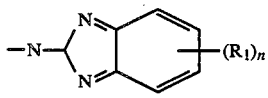
general formula (3)

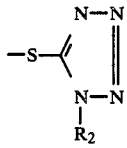
general formula (4)

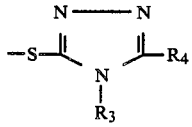
general formula (5)

In general formulas (2A)-(2D) and (3) mentioned above, $R_1$ represents an alkyl group, an alokoxy group, an acylamino group, a halogen atom, an alkoxycarbonyl group, a thiazolideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group or an aryloxycarbonylamino group. n represents 1 or 2 and, in cases where n is 2, $R_1$ may be the same or different and the total number of carbon atoms included in n $R_1$s is 0 to 10.

$R_2$ in the above-mentioned general formula (2E) has the same meaning as $R_1$ of (2A)-(2D) and X represents an oxygen atom or a sulfur atom.

In general formula (4), $R_2$ represents an alkyl group, an aryl group or a heterocyclic group.

In general formula (5), $R_3$ represents a hydrogen atom, an alkyl group, an aryl group or a heterocyclic group, and $R_4$ represents a hydrogen atom, an alkyl group, an aryl group, a halogen atom, an acylamino group, an alkoxycarbonylamino group, an aryloxycarbonylamino group, an alkanesulfonamido group, a cyano group, a heterocyclic group, an alkylthio group or an amino group.

In cases where $R_1$, $R_2$, $R_3$ or $R_4$ represents an alkyl group, it or they may be substituted or unsubstituted, and be either a straight-chain or branched alkyl group or a cyclic alkyl group. As the substituents, there may be mentioned a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group, an arylthio group and the like.

In cases where $R_1$, $R_2$, $R_3$ or $R_4$ represents an aryl group, the aryl group may be substituted. As the substituents, there may be mentioned an alkyl group, an alkenyl group, an alkoxy group, an alkoxycarbonyl group, a halogen atom, a nitro group, an amino group, a sulfamoyl group, a hydroxy group, an carbamoyl group, an aryloxycarbonylamino group, a cyano group, a ureid group and the like.

In cases where $R_1$, $R_2$, $R_3$ or $R_4$ represents a heterocyclic group, it or they represent a 5- or 6-membered single or fused ring including at least one hetero atom selected from a nitrogen atom, an oxygen atom and a sulfur atom, and in particular, may be selected from an pyridyl group, a quinolyl group, a furyl group, a benzothiazolyl group, an oxazolyl group, an imidazolyl group, a thiazolyl group, a triazolyl group, a benzotriazolyl group, an imido group, an oxazine group and the like, which may in turn be further substituted by any of the substituents enumerated for the above-mentioned aryl group.

In general formula (2E) and (4), the number of carbon atoms contained in $R_2$ is 1 to 15.

In general formula (5) mentioned above, the total numbers of carbon atoms contained in $R_3$ and $R_4$ is 1 to 15.

In general formula (1), Y may further represents the following formula (6)

-TIME-INHIBIT (6)

wherein TIME represents a group bonded to the coupling site of a coupler, capable of being cleaved by the reaction with a color developing agent and capable of releasing, after cleavage, an INHIBIT group under appropriate control; an INHIBIT represents a group which functions as a development inhibitor after released.

In general formula (6), the -TIME-INHIBIT group may represent the following general formulas (7)-(13).

general formula (7)

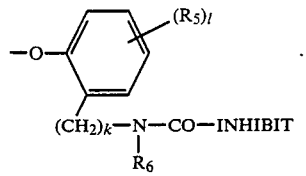

general formula (8)

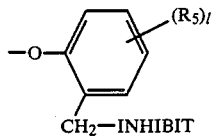

general formula (9)

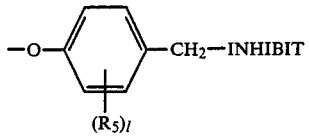

general formula (10)

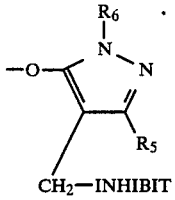

general formula (11)

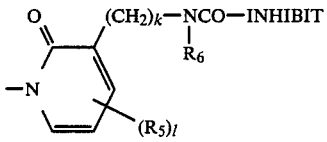

general formula (12)

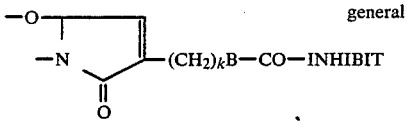

general formula (13)

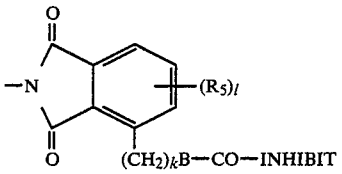

In general formulas (7) to (13), $R_5$ represents a hydrogen atom, a halogen atom, an alkyl group, an alkenyl group, an aralkyl group, an alkoxy group, an alkoxycarbonyl group, an anilino group, an acylamino group, a ureid group, a cyano group, a nitro group, a sulfonamide group, a sulfamoyl group, a carbamoyl group, an aryl group, a carboxy group, a sulfo group, a hydroxy group or an alkanesulfonyl group.

In general formulas (7), (8), (9), (11) and (13), l represents an integer of 1 or 2; in general formulas (7), (11), (12) and (13), k represents an integer of 1 or 2; in general formulas (7), (10) and (11), $R_6$ represents an alkyl group, an alkenyl group, an aralkyl group, a cycloalkyl group or an aryl group; in general formulas (12) and (13), B represents an oxgen atomr or a

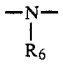

group in which $R_6$ has the same meanings as defined above; and INHIBIT has the same meanings as defined in general formulas (2A), (2B), (3), (4) and (5) except for the number of carbon atoms.

However, in general formula (2A), (2B) and (3), the number of carbon atoms contained in each of $R_1$ in a molecule is 1 to 32 in total; in general formula (4), the number of carbon atoms contained in $R_2$ is 1 to 32; and, in general formula (5), the number of carbon atoms contained in $R_3$ and $R_4$ is 0 to 32 in total.

The alkyl group represented by $R_5$ or $R_6$ may be substituted or unsubstituted and may either be of straight or branched chain or cyclic. As the substituents, there may be mentioned those enumerated for the alkyl group represented by any of $R_1$-$R_4$.

The aryl group represented by $R_5$ or $R_6$ may be substituted. As the substituents, there may be mentioned those enumerated for the aryl group represented by any of $R_1$-$R_4$.

The ary group represented by $R_5$ or $R_6$ may be substituted. As the substituents, there may be mentioned those enumerated for the aryl group represented by any of $R_1$-$R_4$.

Among the diffusible DIR compounds represented by general formula (1) mentioned above, especially preferred are the compounds which have the leaving group represented by general formula (2A), (2B) or (5).

As the coupler residue capable of forming a yellow dye image represented by A in the general formula (1), there may be mentioned coupler residues of the pivaloylacetanilide type, the benzoylacetanilide type, the malonic acid diester type, the malonic acid diamide type, dibenzoylmethane type, the benzothiazolylacetamide type, the malonic acid monoester monoamide type, the benzothiazolyl acetate type, the benzoxazolylacetamide type, the benzoxazolyl acetate type, the benzimidazolylacetamide type or the benzimidazolyl acetate type; coupler residues derived from an acetamide substituted by a heterocyclic ring or an acetate substituted by a heterocyclic ring, as disclosed in U.S. Pat. No. 3,841,880; coupler residues derived from acylacetamides, as described in U.S. Pat. No. 3,770,440, British Pat. No. 1,459,171, West Germany Offenlegungesschrift (OLS) No. 25 03 099, Japanese Provisional Patent Publication (JAPAN KOKAI) No. 139738/1975 and Research Disclosure No. 15737; and heterocyclic type coupler residues as described in U.S. Pat. No. 4,046,574.

As the coupler residue represented by A capable of forming a magenta dye image, there may preferably be mentioned those having a 5-oxo-2-pyrazoline nucleus, a pyrazolo-[1,5-a]benzimidazole nucleus or a cyanoacetophenone type coupler residue.

As the coupler residue represented by A capable of forming a cyan dye image, there may preferably be mentioned a coupler residue having a phenol nucleus or an α-naphthol residue, or a coupler residue of an imidazolone series or a pyrazolotriazole series.

Further, even if the coupler does not substantially form any dye after having been subjected to coupling reaction with an oxidized form of a development agent to release a development inhibitor, the effect thereof as a DIR coupler is the same as in the case where a dye is formed. As the couplers of this type represented by A, there may be mentioned those as described in U.S. Pat. Nos. 4,052,213; 4,088,491; 3,632,345; 3,958,993; and 3,961,959.

In the present invention, the diffusibility of the inhibiting group can be evaluated according to the method described below.

On a transparent support, light-sensitive samples (IV) and (V) comprising the layers with the following compositions are prepared.

Sample (I): A sample having a green-sensitive silver halide emulsion layer

A gelatin coating solution containing a silver iodobromide (silver iodide 6 mole %, average grain size 0.48 μm) spectrally sensitized to green-sensitive and 0.07 mole of the exemplary coupler (M-2) per mole of silver was applied to a coated silver amount of 1.1 g/m$^2$ and a gelatin attached amount of 3.0 g/m$^2$, followed by coating thereon of a protective layer: a gelatin coating solution containing silver iodobromide (silver iodide 2 mole %, average grain size 0.08 μm) not applied with chemical sensitization and spectral sensitization to a coated silver amount of 0.1 g/m$^2$ and a gelatin attached amount of 0.8 g/m$^2$.

Sample (II): The protective layer in the above sample (I) from which silver iodobromide is removed.

In the respective layers, there are contained gelatin hardeners and surfactants in addition to the above components.

The samples (I) and (II) are subjected to white light exposure and then processed according to an ordinary processing method as provided that the developing time is set to be 2 min. 40 sec. In the developing solutions employed, various developing inhibitors are added in an amount of inhibiting the sensitivity of the sample (II) to 60% (in terms of logarithmic representation, $-\Delta \log E=0.22$), or no developing inhibitor is added at all.

When no developing inhibitor is added, the sensitivity of the sample (I) is defined as $S_O$ and the sensitivity of the sample (II) as $S_O'$, while when developing inhibitor is added, the sensitivity of the sample (I) is defined as $S_{IV}$ and the sensitivity of the sample (II) as $S_V$.

Sensitivity reduction of sample (I):

$$\Delta S_O = S_O' - S_V.$$

Sensitivity reduction of sample (II):

$$\Delta S = S_O S_{IV}.$$

$$\text{Diffusiveness} = \Delta S / \Delta S_O.$$

Sensitivities are all logarithmic values of the reciprocal of exposure dose ($-\log E$) at the density point with fog density+0.3.

The value determined by this method is made a measure of diffusibility. Diffusivenesses of several kinds of developing inhibitors are shown in Table 3.

In the present invention, it is preferred that $\Delta S/\Delta S_O$ exceeds 0.34 and more preferably it is not less that 0.4.

As the preferred diffusible DIR couplers to be used in the present invention, there may be mentioned the following compounds, to which however the present invention should not be construed to be limited.

D-1

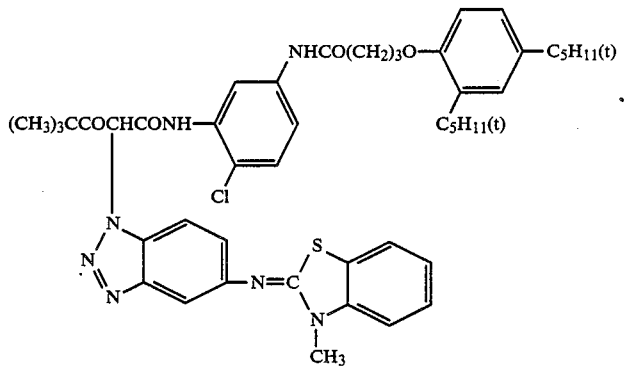

D-2

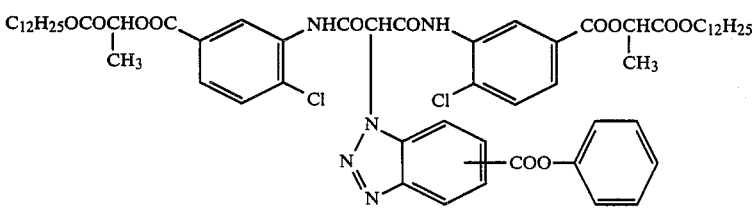

-continued
D-3
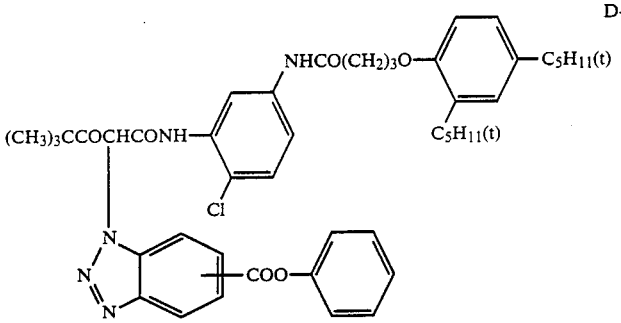
D-4
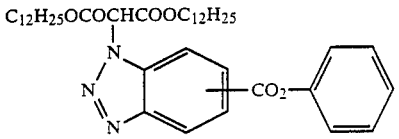
D-5
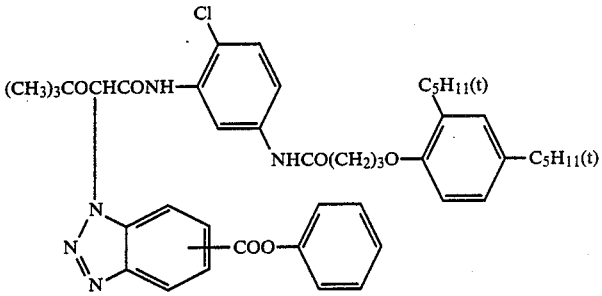
D-6
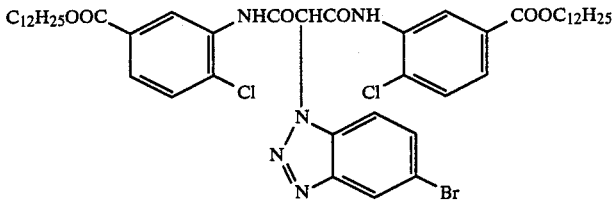
D-7
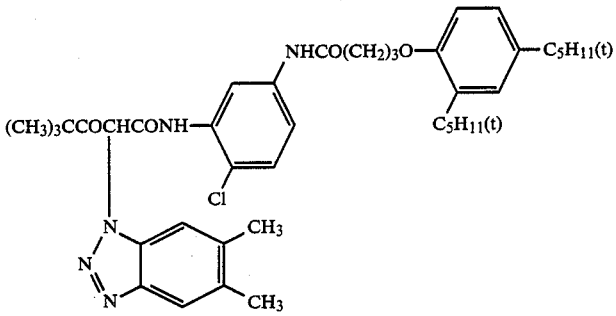
D-8
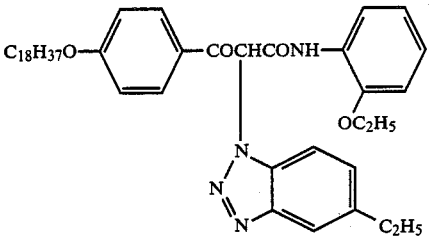
D-9
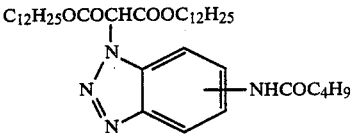
D-10
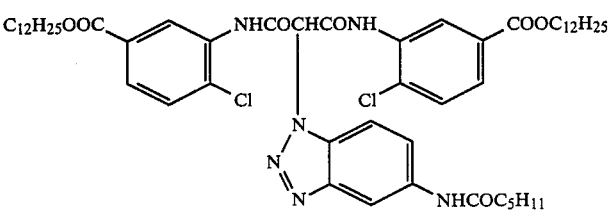

-continued
D-11
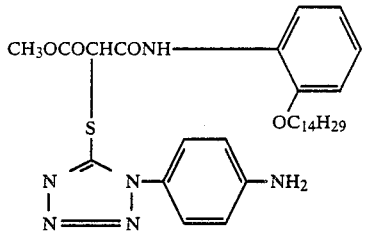
D-12
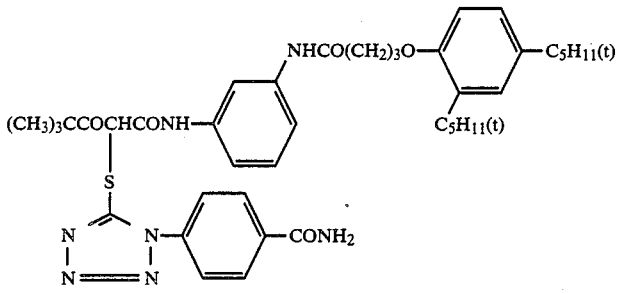
D-13
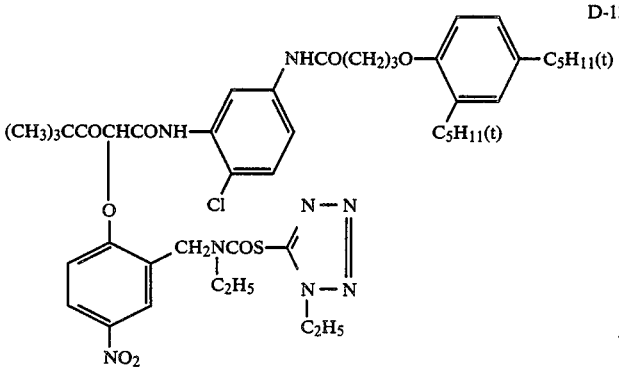
D-14
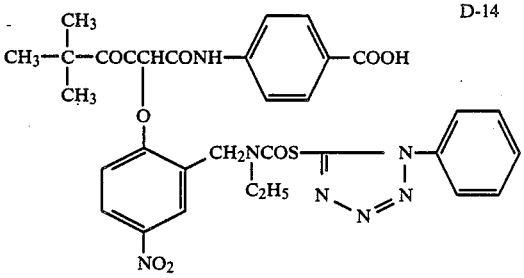
D-15
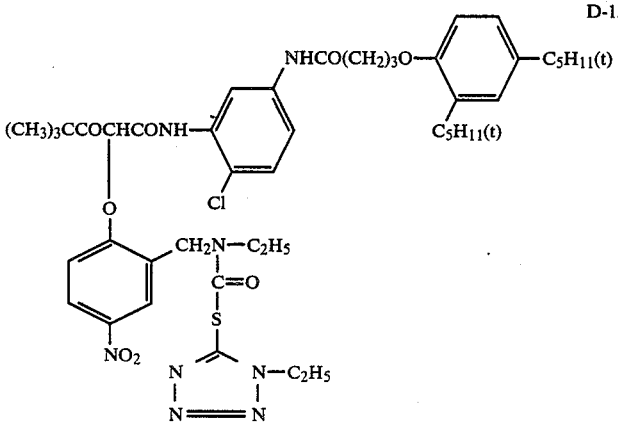
D-16
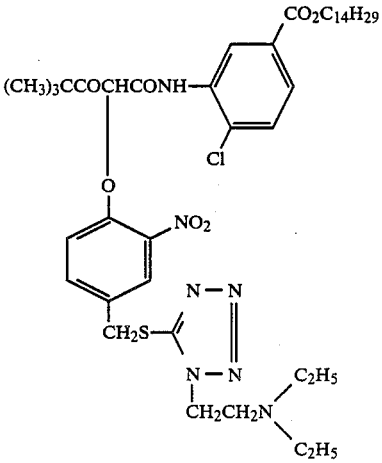

-continued
D-17
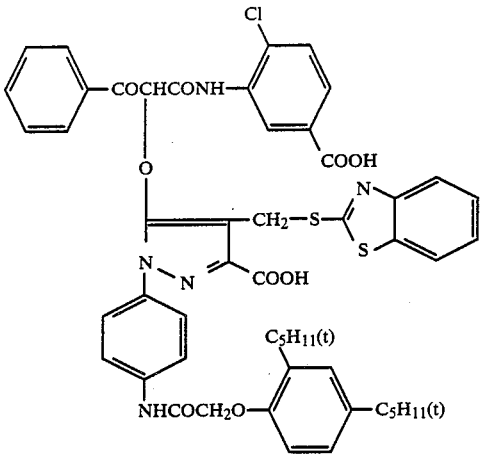
D-18
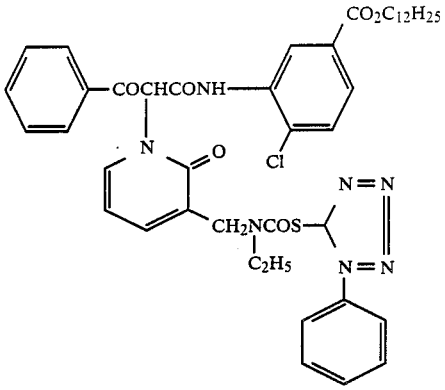
D-19
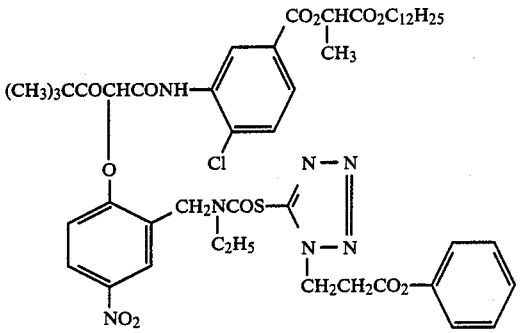
D-20
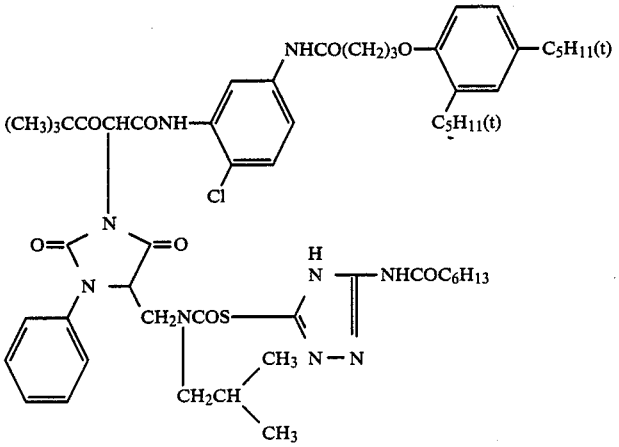

-continued
D-21
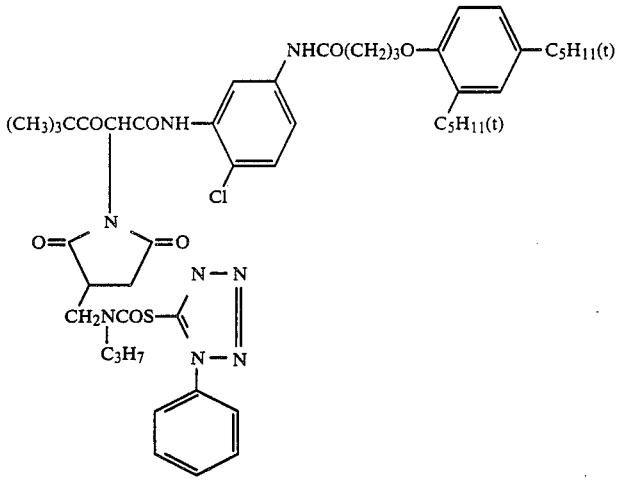
D-22
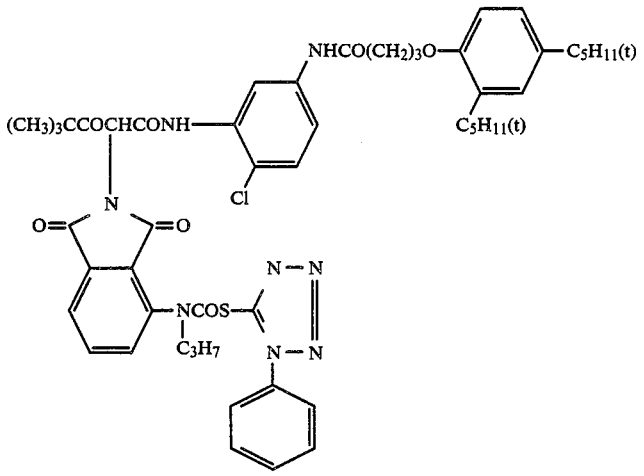
D-23
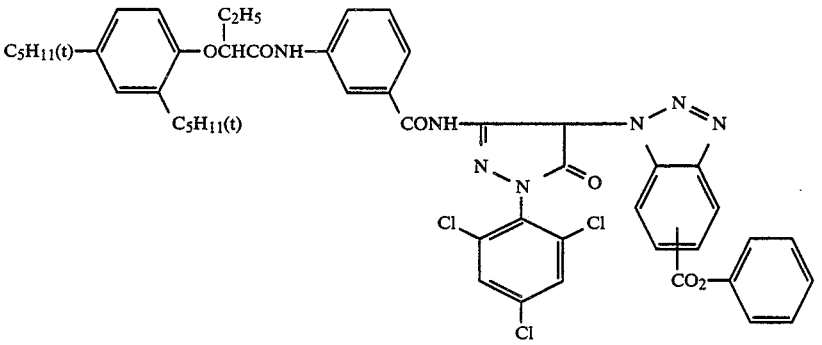
D-24
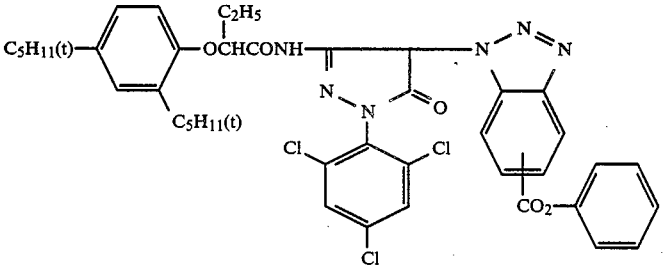

-continued
D-25
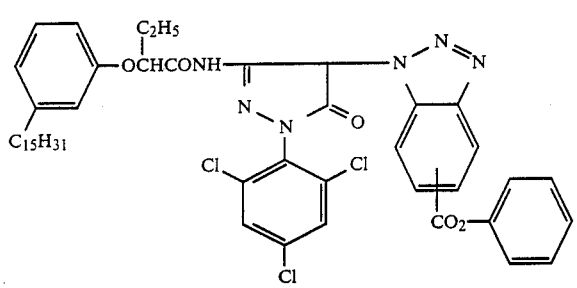
D-26
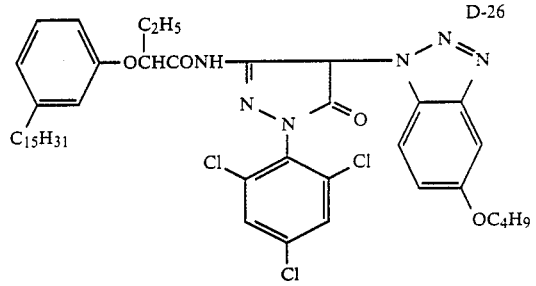
D-27
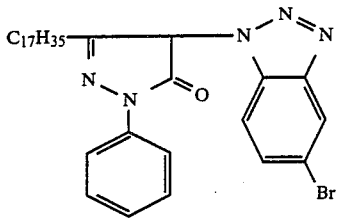
D-28
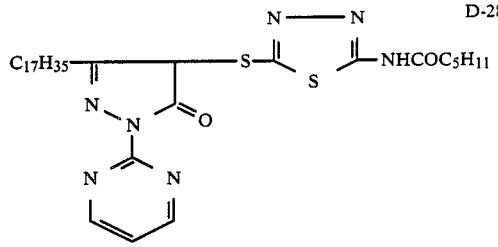
D-29
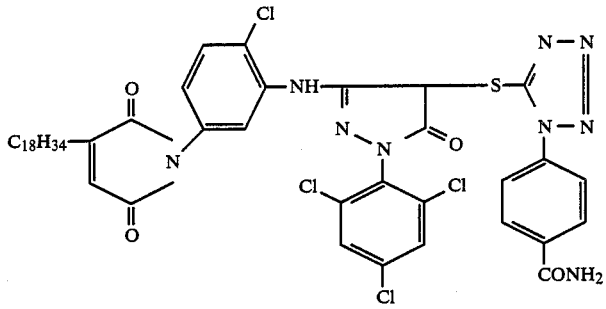
D-30
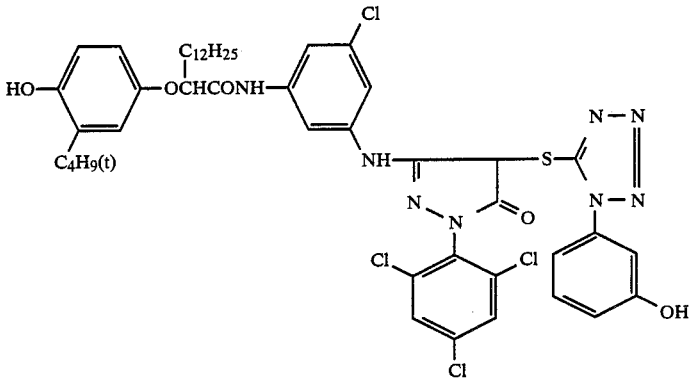
D-31
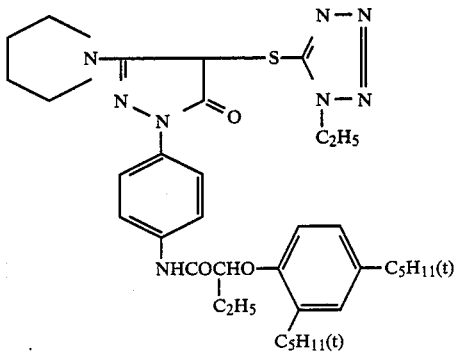
D-32
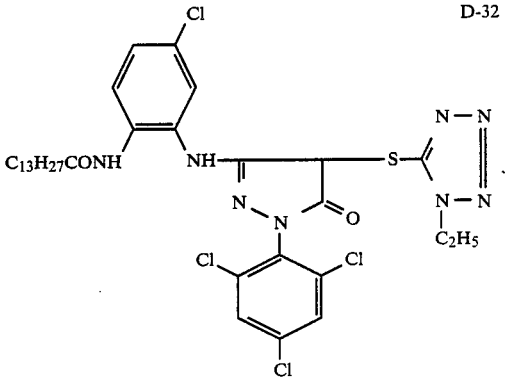

-continued
D-33
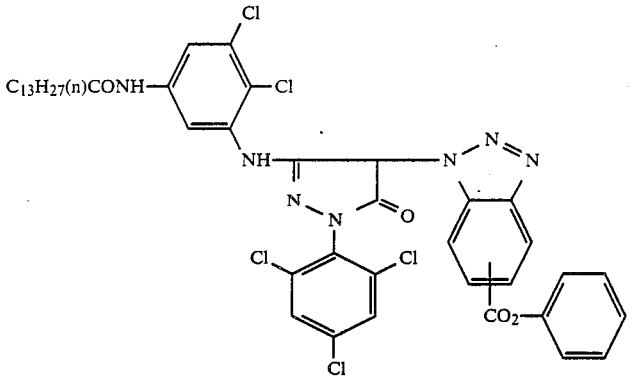
D-34
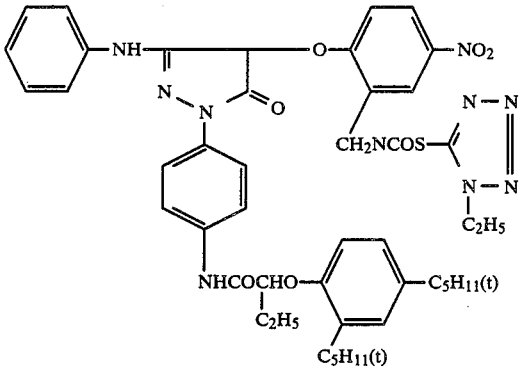
D-35
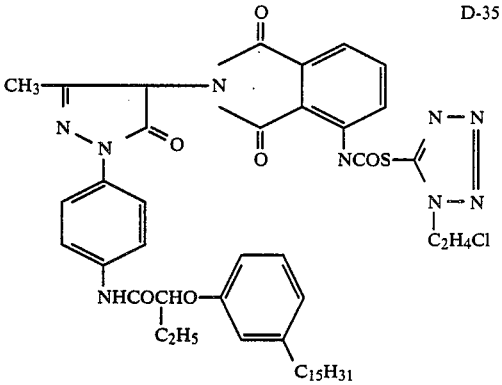
D-36
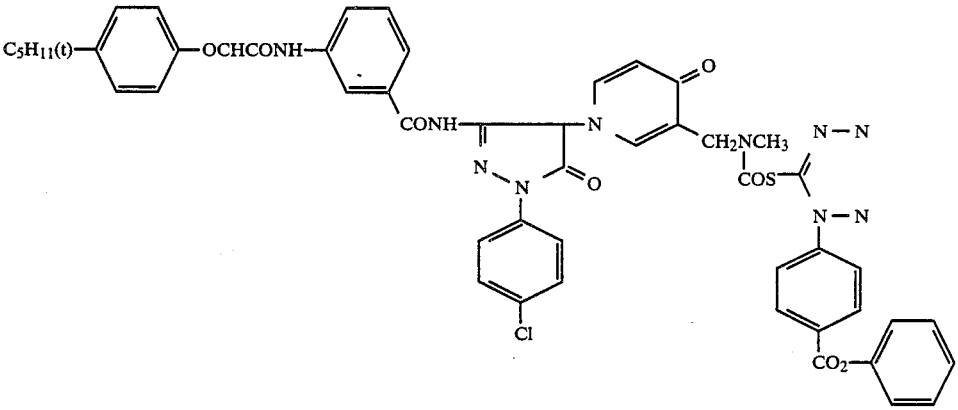
D-37
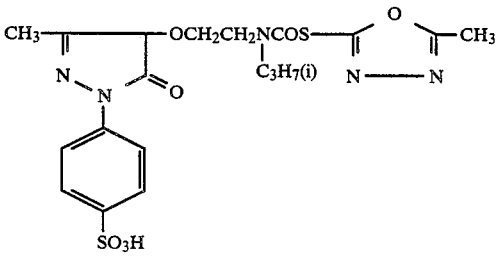
D-38
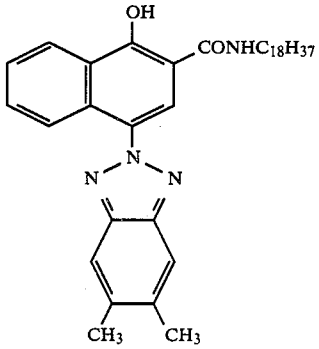

-continued
D-39
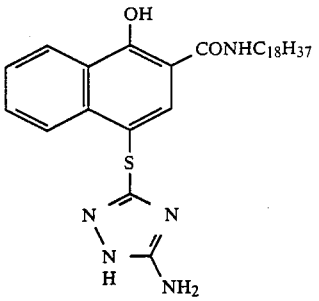
D-40
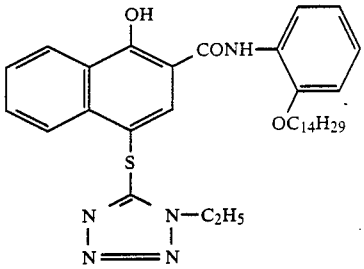
D-41
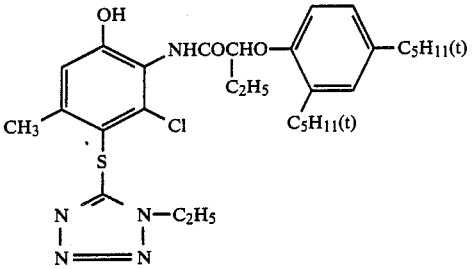
D-42
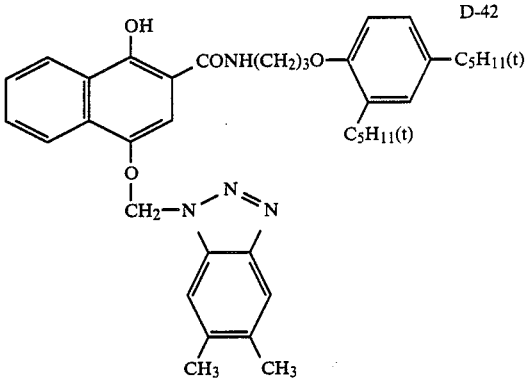
D-43
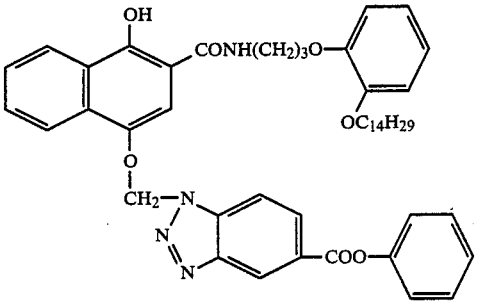
D-44
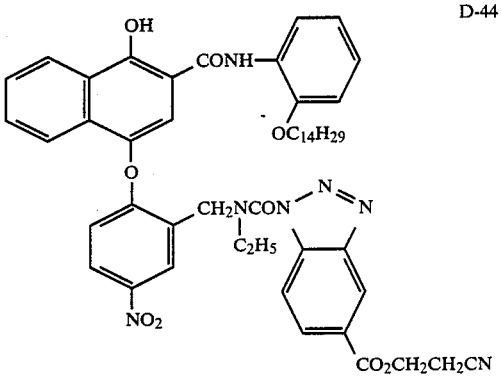
D-45
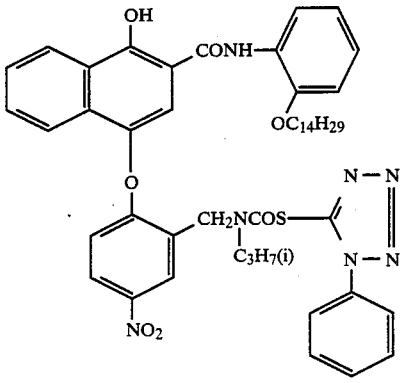
D-46
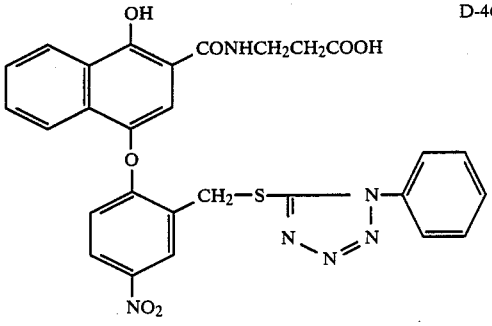

-continued
D-47
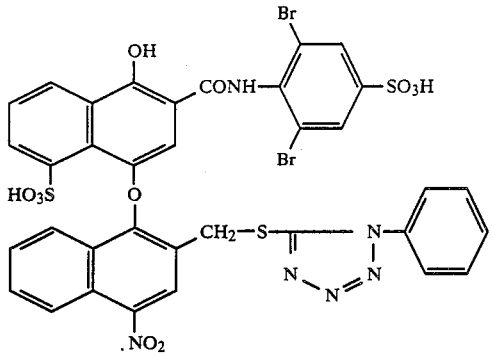
D-48
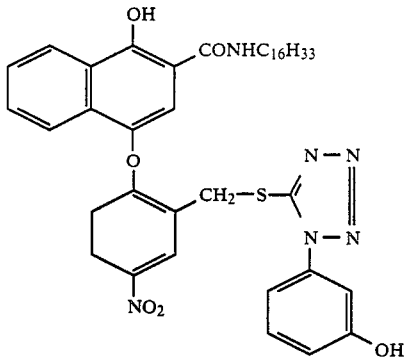
D-49
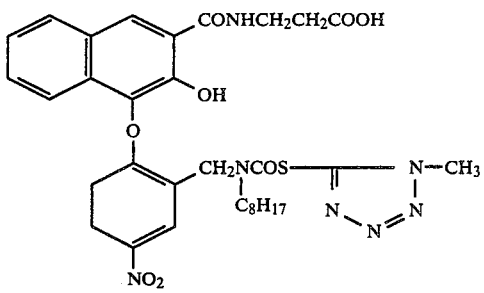
D-50
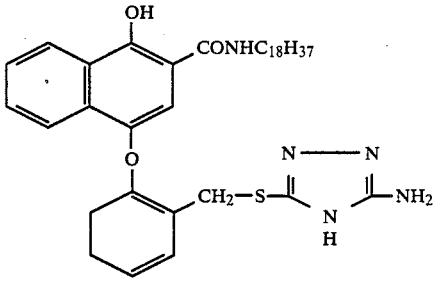
D-51
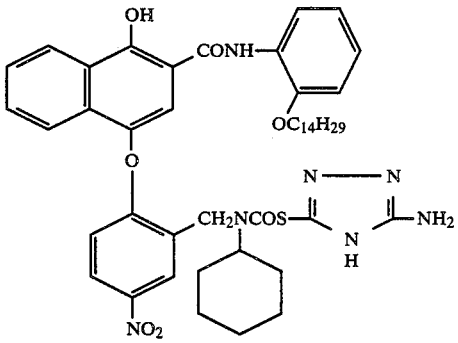
D-52
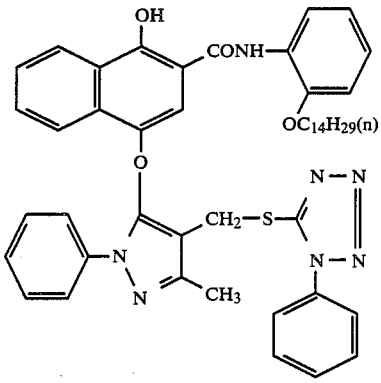
D-53
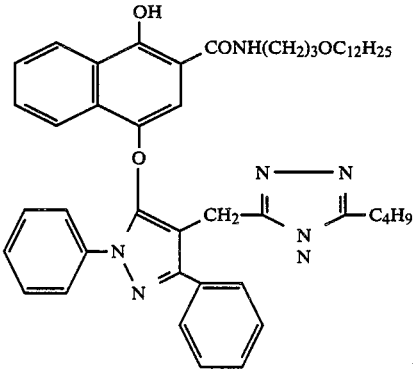
D-54
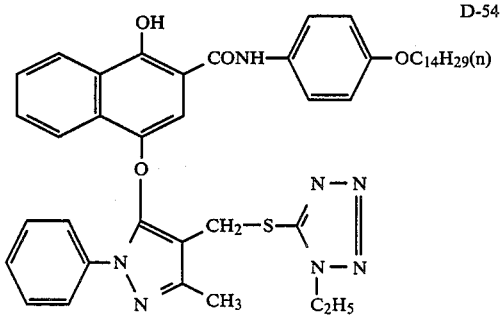

-continued
D-55
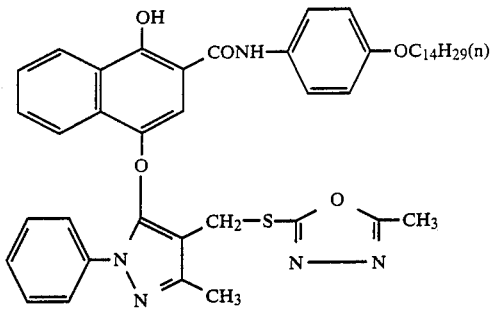
D-56
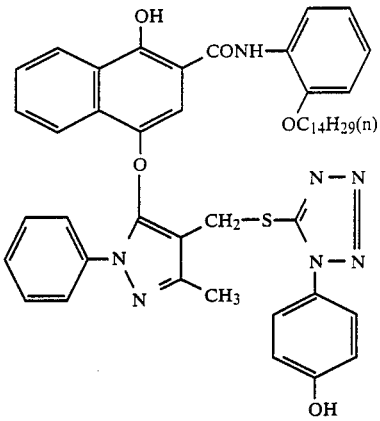
D-57
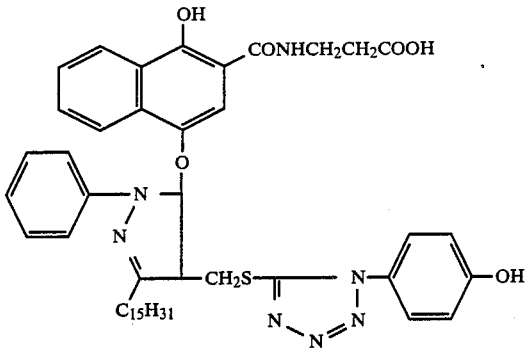
D-58
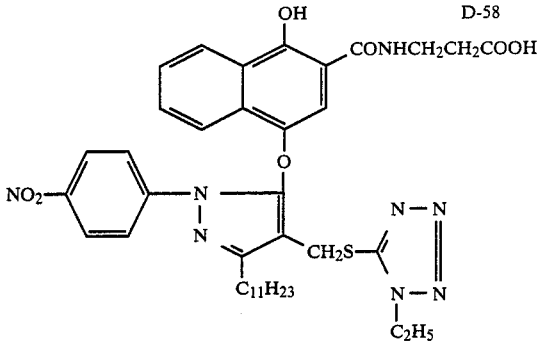
D-59
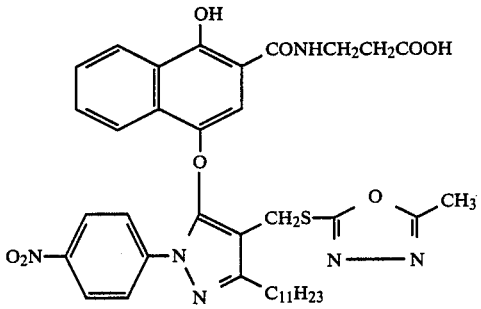
D-60
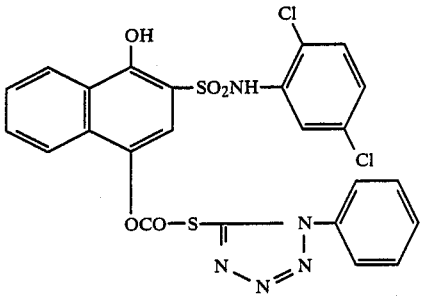
D-61
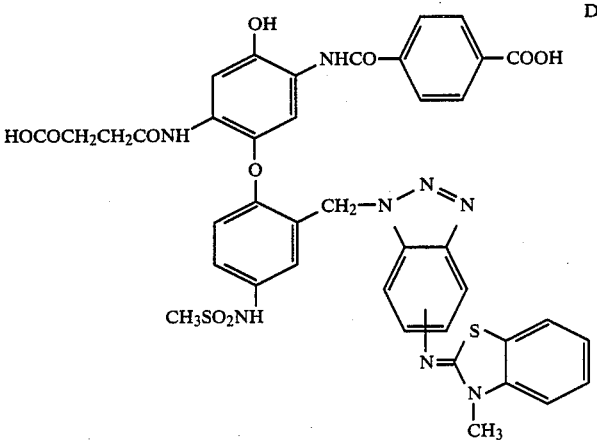
D-62
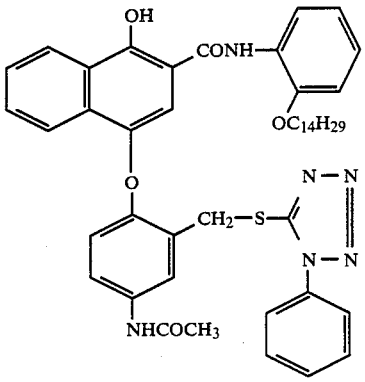

-continued

D-63

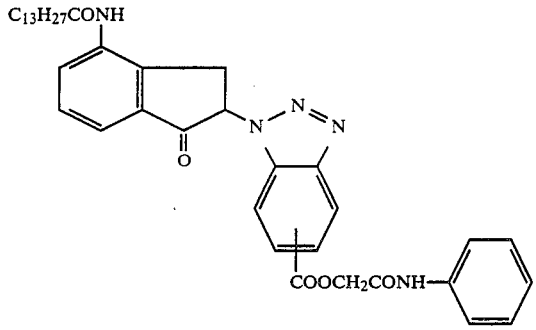

These compounds may easily be synthesized according to the methods as disclosed in U.S. Pat. Nos. 4,234,678, 3,227,554, 3,617,291, 3,958,993, 4,149,886, 3,933,500; Japanese Provisional Patent Publications (JAPAN KOKAI) Nos. 56937/1982, 13239/1976; U.S. Pat. Nos. 2,072,363, 2,070,266; Research Disclosure No. 21228 (December, 1981); and so on.

In the present invention, any non-diffusible green absorptive or red absorptive dye may be employed if, after it is added at the time of preparation of a light-insensitive hydrophilic colloidal layer in the course of manufacturing a color light-sensitive material, it exists substantially in the light-insensitive hydrophilic colloidal layer without any migration thereof to other layers even after completion of the manufacturing.

For the non-diffusible dye, there may be employed, for instance, an acidic dye which has been made nondiffusible by making a diffusible acidic dye and a polymar mordant having a basic group coexist in the same light-insensitive hydlophilic colloidal layer.

As the polymer mordants having a basic group as mentioned above, there may be mentioned, for example, a polymer which contains imidazol, pyridine, alkylaminoalkyl(meth)acrylate or their quarternary salts, aminoguanidine or the like. Basic polymar mordants which may be empolyed preferrably are discribed in detail in each of the specifications of the U.S. Patents having the following Patents Numbers: U.S. Pat. Nos. 2,548,564, 2,675,316, 2,882,156 and 3,706,563, among which especially preferred basic polymer mordants in the present invention are a condensation product of a poly vinylalkyl ketone or a poly-N-oxoalkyl(meth)-acrylnamide with an aminoguanidine as described in the specifications of U.S. Pat. Nos. 2,882,156 and 3,706,563.

Next, representative examples for the basic polymer mordant to be employed preferably in the present invention will be enumerated below.

[Mordant - 1]

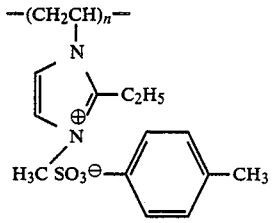

n = 500

[Mordant - 2]

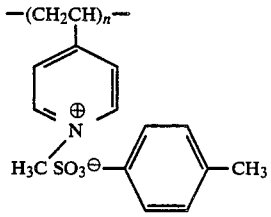

n = 500

[Mordant - 3]

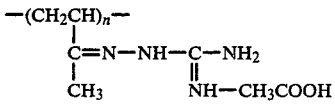

n = 300

[Mordant - 4]

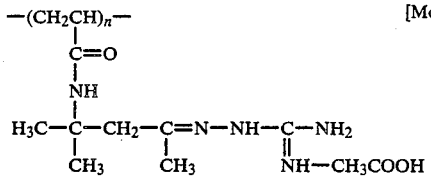

n = 300

As the dye to be used in combination with the above-mentioned basic polymer mordant in the present invenition, any acidic dye may be used. There may preferably be used acidic dyes having a sulfo group or a carboxy group, for example, acidic dyes of the azo series, the triphenylmethane series, the anthraquinone series, the styryl series, the benzylidene series, the melocyanine series, the oxonol series and the like.

Next, representative examples for the acidic dyes to be used in the present invention will be enumerated below.

[Dye-1]

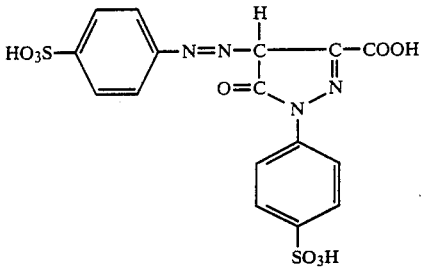

[Dye-2]

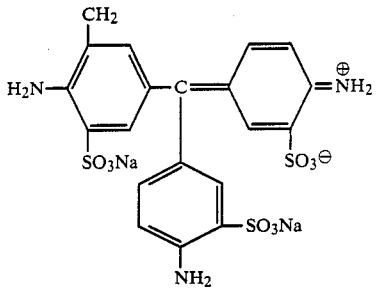

[Dye-3]

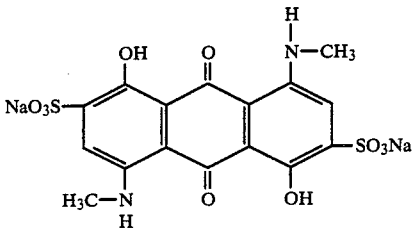

[Dye-4]

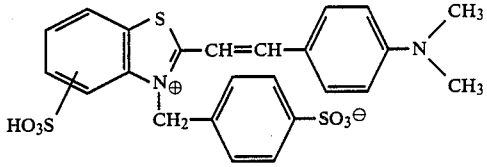

[Dye-5]

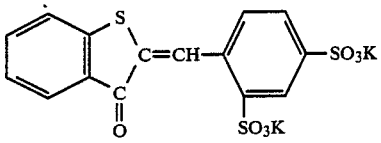

[Dye-6]

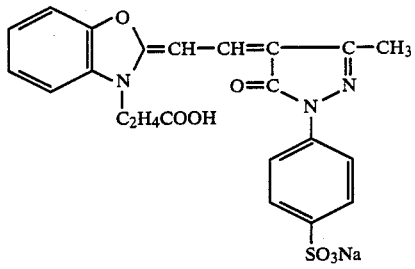

[Dye-7]

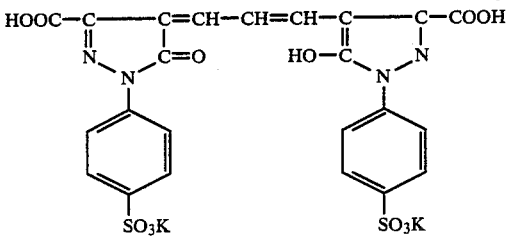

[Dye-8]

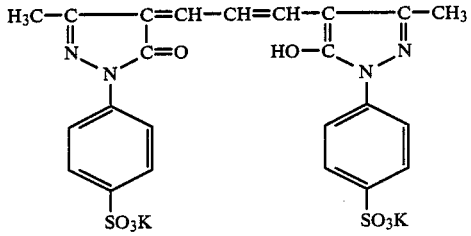

[Dye-9]

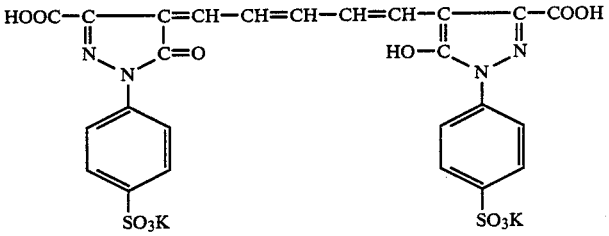

The acidic dyes and the basic polymer mordants mentioned above may be synthesized by means of known methods and they may be incorporated in a light-insensitive hydrophilic colloidal layer.

As an example for the non-diffusible green absorptive dye to be employed preferably in the present invention, there may be mentioned reaction products of a known magenta coupler with a known color development agent. As an example for the preferred non-diffusible red absorptive dye according to the present invention, there may be mentioned a reaction product of a known cyan coupler with a known color developing agent.

As the above-mentioned magenta coupler, there may specifically be mentioned those of the pyrazolon series, the pyrazolotriazole series, the pyrazolinonebenzimadazole series and the indazolon series as represented by the following general formulas (14) to (18):

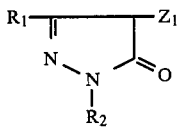

general formula (14)

-continued

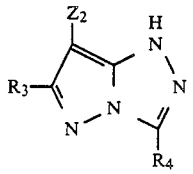

general formula (15)

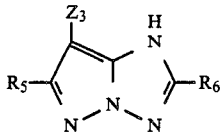

general formula (16)

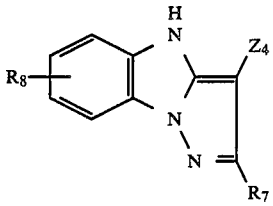

general formula (17)

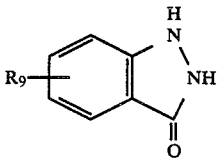

general formula (18)

In the above formulae, $Z_1$–$Z_4$ represent, independently of each other, a hydrogen atom or a group capable of being eliminated by the reaction with an oxidized form of a color developing agent; $R_1$ represents an amilino group, an acylamino group, a ureido group or an aliphatic group; $R_2$ represents a phenyl group which may be substituted; $R_3$ to $R_9$ represent, independently of each other, a hydrogen atom or a substituent group which may be employed in an ordinary magenta coupler; and $R_8$ and $R_9$ may be substituted by two or more substituents which may be the same or different from each other.

As such magenta couplers, there may be mentioned those as described in U.S. Pat. Nos. 2,600,788, 2,983,608, 3,062,653, 3,127,269, 3,311,476, 3,419,391, 3,519,429, 3,558,319. 3,582,322, 3,615,506, 3,834,908, and 3,891,445; West Germany Pat. No. 18 10 464; West German Offenlegungsschrift (OLS) No. 24 08 665, 24 17 945, 24 18 959, 24 24 467; Japanese Patent Publication No. 6031/1965; Japaense provisional Patent Publicaions (JAPAN KOKAI) Nos. 74027/1974, 74028/1974, 129538/1974, 60233/1975, 159336/1975, 20826/1976, 26541/1976, 42121/1977, 58922/1977, 55122/1978, Japanese Patent Application No. 110943/1980.

In addition, as the cyan coupler mentioned above, there may be mentioned, for example, a phenol or a naphtol derivative as represented by the following general formulas (19) and (20):

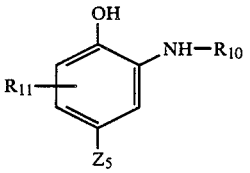

general formula (19)

-continued

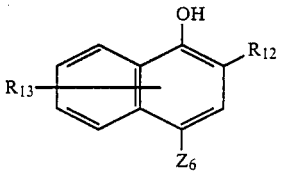

general formula (20)

In the above formulae, $Z_5$ and $Z_6$ represent, independently of each other, a hydrogen atom or a group capable of being eliminated by the reaction with an oxidized form of a color developing agent; $R_{10}$ represents an acyl group, a carbamoyl group, an oxycarbonyl group, an aliphatic residue, an aromatic residue or a heterocyclic residue; $R_{12}$ represents a carbamoyl group; $R_{11}$ and $R_{13}$ represent, independently of each other, a hydroge atom or a substituent which may be used in an ordinary phenol or naphthol type cyan coupler, and may be substituted by two or more substituents which are the same or different from each other.

As such couplers, there may preferably be mentioned those as described in U.S. Pat. Nos. 2,423,730, 2,474,293, 2,801,171, 2,895,826, 3,476,563, 3,737,326, 3,758,308, 3,893,044; Japanese Provisional Patent Publications (JAPAN KOKAI) Nos. 37425/1972, 10135/1975, 25228/1975, 112038 117422/1975, 130441 and 98731/1983.

As the known color developing agent which is reacts with the coupler mentioned above, there may preferable be mentioned aromatic primary amine series compounds, especially, p-phenylenediamine series compounds, for example, N,N-diethyl-p-phenylenediamine hydrochloride, N-ethyl-p-phenylenediamine hydrochloride, N,N-dimethyl-p-phenylenediamine hydrochloride, 2-amino-5-(N-ethyl-N-dodecylamino)-toluene, N-ethyl-N-(β-methanesulfonamidoethyl)-3-methyl-4-aminoaniline sulfate, N-ethyl-N-β-hydroxyethylaminoaniline, 4-amino-N-(2-methoxyethyl)-N-ethyl-3-methylaniline p-toluenesulfonate, N,N-diethyl-3-methyl-4 aminoaniline, N-ethyl-N-(β-hydroxyethyl)-3-methyl-4-aminoaniline and so on.

As other preferred examples for the nondiffusible green color absorptive dye, there may be mentioned known colored cyan couplers.

As such colored cyan couplers known to the art, there may be mentioned the compounds as described in, for example, U.S. Pat. Nos. 2,521,908, 3,034,892; British Pat. No. 1,255,111, Japanese Provisional Patent Publication (JAPAN KOKAI) No. 22028/1973 and so on.

Further, there may be also employed a colored cyan coupler of the type, as described in U.S. Pat. No. 3,476,563, Japanese Provisional Patents Publications (JAPAN KOKAI) Nos. 10135/1975, 123341/1975 and so on, in which a dye is shifted into a processing bath by the reaction with an oxidation product of a colored developing solution.

Especially preferred colored couplers are compounds represented by the following general formula [I]-a or [II]-b.

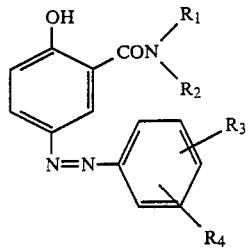

general formula [I] - a

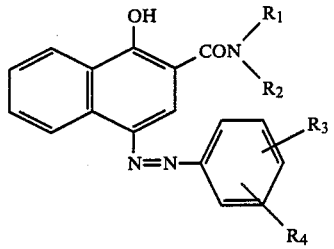

general formula [I] - b

In general formulas [I]-a and [I]-b, $R_1$ and $R_2$ represent, independently of each other, a hydrogen atom, a straight-chain or branched alkyl group having 1 to 30 carbon atoms, a mono- or bicycloalkyl group (e.g., a cyclohexyl group), a terpenyl group (e.g., a norbornyl group), an aryl group (e.g., a phenyl group and a naphthyl group), a heterocyclic group (e.g., a benzimidazolyl group and a benzothiazolyl group), or $R_1$ and $R_2$ may represent non-metallic atoms necessary for forming, together with the nitrogen atom to which they are attached, a heterocyclic group such as morpholine and pyridine.

The alkyl group, the aryl group and the heterocyclic group mentioned above may be substituted. As such substituents, there may be mentioned the following groups or atoms, that is, a halogen atom, a nitro group, a hydroxy group, a carboxy group (in cases where the coupler contains, at the non-coupling position, a ballast group having 12 carbon atoms or so), an amino group, an aryl group, a substituted amino group (such as alkylamino, dialkylamino, anilino, N-alkylanilino), a carboxylic acid ester group (such as carboalkoxy, carboaryloxy), an amido group (such as acetamido, butyramido, ethylsulfonamido, N-methylbenzamido, N-propylbenzamido, 4-t-butylbenzamido), a carbamyl group (such as carbamyl, N-octadecylcarbamyl, N,N-dihexylcarbamyl, N-methyl-N-phenylcarbamyl, 3-pentadecylphenylcarbamyl), a sulfamyl group (in cases where the coupler contains, at the non-coupling site, a ballast group having 12 carbon atoms or so, such as N-propylsulfamyl, N-tolylsulfamyl), an alkoxy group (such as ethoxy, octadecyloxy), a sulfo group (in cases where the coupler contains, at the non-coupling site, a ballast group having 12 carbon atoms or so), a substituted sulfonyl group (such as methylsulfonyl, octadecylsulfonylethoxysulfonyl, decyloxysulfonyl, phenylsulfonyl, trisulfonyl, phenoxysulfonyl) and so on.

$R_3$ represents a group —$COR_5$ or a group —$COOR_5$ (in which $R_5$ represents an alkyl group or a substituted alkyl group each having 1 to 20 carbon atoms) and $R_4$ represents a hydrogen atom or an alkyl group having 1 to 10 carbon atoms.

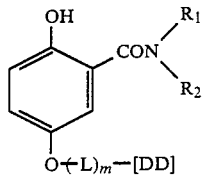

general formula [II]-a

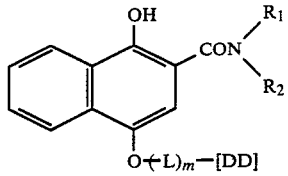

general formula [II]-b

In general formulas [II]-a and [II]-b, $R_1$ represents a hydrocarbon residue and $R_2$ represents an amino group, an alkyl group, an acylamino group, a ureid group, an alkoxycarbonyl group or a substituted group of these groups, a carboxyl group or the like. The —L— represents an alkyleneoxy group having 1 to 6 carbon atoms, and m represents 0 or 1.

[DD] represents a diffusible dye residue, that is, a diffusible dye residue having such a known dye portion as azo, azomethyne, indoaniline, indophenol, anthraquinone and the like.

Preferred [DD] may be represented by the following formulas.

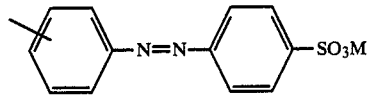

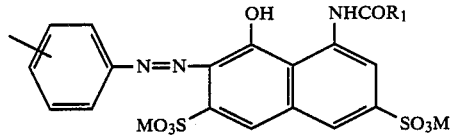

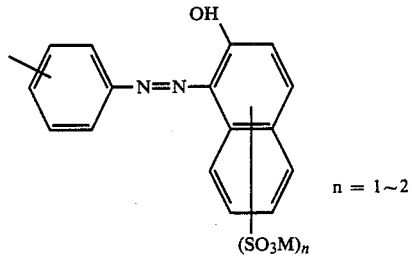

n = 1~2

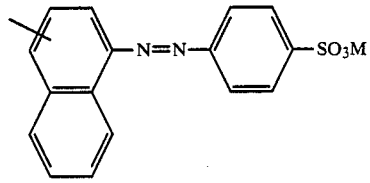

-continued

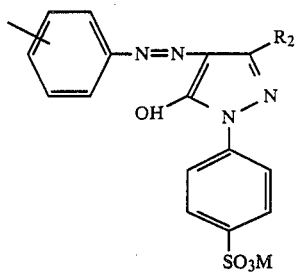

In the above formulas, M represents a monovalent metal atom; and $R_1$ and $R_2$ represent, independently of each other, a hydrogen atom, a straight-chain or branched alkyl group having 1 to 30 carbon atoms, a substituted alkyl group having 1 to 30 carbon atoms, a cycloalkyl group having 3 to 30 carbon atoms, an aryl group (e.g., a phenyl group, a naphthyl group, etc.) or a heterocyclic group.

As other preferred examples for the non-diffusible dye to be employed in the present invention, there may be mentioned the compounds represeted by the folowing general formula [III].

general formula [III]

Ball-$(X)_n$-Col wherein the —Ball represents a stabilizing organic group having such a molecular size, a configuration or an arrangement as renders the compound non-diffusible during the develoment in a basic processing composition.

The above-mentioned examples of the stabilizing organic group may include, for example, the group represeted by the following formulas [I] to [III].

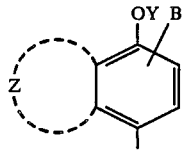

(I)

In formula (I), Z represents a group of non-metallic atoms necessary for forming a saturated carbocyclic ring fused at the 5 and 6 positions on the benzene ring to which the group —OY is bonded. While Y may most preferably be a hydrogen atom, it may be a group in which the bond with the oxygen atom is cleaved at a hydroxide ion concentration of $10^{-5}$ to 2 moles/l depending upon the application and the property of a photographic element to be added.

Among the latter groups, it is a group

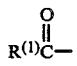

or a group

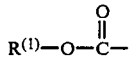

(in which $R^{(1)}$ represents an alkyl group having 1 to 18 carbon atoms, an alkyl group having 1 to 18 carbon atoms and having been substituted by a halogen atom or atoms, or a phenyl group or a substituted phenyl group) that exhibits more advantageous effect.

B represents an organic group capable of rendering the compound of the above-mentioned general formula [III] non-diffusible in a color light-sensitive material. As the organic group, there may be mentioned, as representative examples, a long chain alkyl group; an aromatic group such as those of the benzene or the naphthalene series; or a group having a long chain alkyl group or an aromatic group bonded to one end of a suitable divalent group.

Here, the long chain alkyl group or the aromatic group may be substituted, and the suitable divalent group may include, as its constituting element, one selected from the group consisting of —O—; —S—;

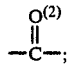

$—SO_2—$; —SO—;

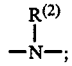

$—CR^{(3)}R^{(4)}—$; $—CR^{(3)}{=}CR^{(4)}—$; (wherein $R^{(2)}$ represents a hydrogen atom, an alkyl group or an aryl group, and $R^{(3)}$ and $R^{(4)}$ each represent a hydrogen atom, a halogen atom, an alkyl group or an aryl group) and a substituted or unsubstituted divalent aromatic group, non-aromatic carbocyclic group and non-aromatic heterocyclic group and may be constituted by one or more (a plural number) of these groups or moieties combined optionally with each other in the form of a straight chain.

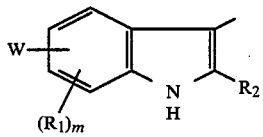

(II)

In formula [II], W represents an organic group capable of rendering the above-mentioned compounds of general formula [III] non-diffusible in a color light-sensitive material. As the organic group, there may be mentioned an organic stabilizing e group having an aliphatic group, an aromatic group, an alicyclic group or a heterocyclic group, each having generally 8 to 20 carbon atoms. In the compounds according to the present invention, these groups are linked to the indol ring at the 5 or 6 position through a nitrogen atom. As embodiment for such linkage through a nitrogen atom, there may be mentioned are linkages through a group —NHCO—, a group $—NHSO_2—$, a group $—NH_3—$ (in which $R_3$ represents a hydrogen atom or an alkyl group) or the like. While above-mentioned organic stabilizing group may be linked at the 5 or 6 position on the indol ring, linkage at the 5 position may be preffered.

In general formula (II), $R_1$ represents a monovalent organic group which includes, for example, an alkyl group and an alkoxy group with an alkyl group and an alkoxy groups each having 1 to 3 carbon atoms being preferred.

In general formula (II), $R_2$ represents a low moleculer group bonded through a carbon atom which may be preferably a substituent having 1 to 9 carbon atoms, for example, an alkyl group having 1 to 9 carbon atoms, a phenyl group and a group

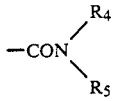

(in which $R_4$ and $R_5$ each represent a hydrogen atom or an alkyl group having 1 to 4 carbon atoms, or $R_4$ and $R_5$ may cooperate to form a ring).

$R_2$ may include more preferably a phenyl group which may be unsubstituted or substituted by a group selected from the class consisting of a halogen atom, an acetylamido group, a methylsulfonamido group, a nitro group, a carboxy group, a sulfo group, a methanesulfone group, an alkyl group and an alkoxy group.

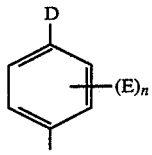

(III)

In the formula, Es may be the same or different and each represent a halogen atom, a sulfo group, a carboxy group, an alkyl group, an aryl group, an alkoxy group, an aryloxy group, a nitro group, an amino group, a cyano group, an alkylamino group, an arylamino group, a cyano group, a alkylthio group or a heterocyclic group such as a pyridyl group, which is directly bonded or indirectly bounded through

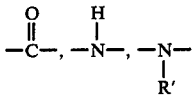

(in which R′ is an alkyl group), an alkylene group (which may be branched), —O—, —S—, —$SO_2$—, a phenylene group (which may be substituted) or a group in which these groups or moieties may optionally be combined with each other.

n represents an integer of 0 to 4.

D is a group represented by —$OR_1$ or —$NHR_2$ wherein $R_1$ represents a hydrogen atom or a group of which the bond with the oxygen atom can be cleaved under conditions of a hydroxide ion concentration of $10^{-5}$ to 2 mol/l with a hydrogen atom, a group

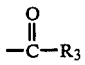

or a group

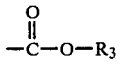

(in which $R_3$ is an alkyl group, particularly an alkyl group having 1 to 18 carbon atoms) being preferred.

In general formula [III], X represents a suitable divalent group, which includes —O—, —S—,

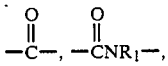

—$SO_2$—, —SO—, —$NR^1CO$—, —$NR1SO_2$—, —$CR^2$-$R^3$—, —$CR^3$=$CR^4$— and so on, wherein $R^1$ represents a hydrogen atom, an alkyl group or an aryl group, $R^2$ and $R^3$ each represent a hydrogen atom, an alkyl group or an aryl group.

The moiety -Col in general formula [III] represents a diffusible magenta or cyan dye component, or a precursor component thereof.

Such components are well-known to a person having skill in the art and include dyes such as an azo, azomethyne, azopyrazolone, indolaniline, indophenol, anthraquinone, triarylmethane, alizarin, merocyanine, nitro, quinoline, cyanine, indigoid, phthalocyanine, metal complex forming dyes and so on, Leuco dyes, dye precursors such as shifted dyes which are shifted hypsochromically or bathochromically when the different environments such as the change of pH values, the reaction with the complex forming substance are applied. Further, the moiety -Col may be a coupler component such as phenol, naphthol, indazolone, pyrazolone, and the compounds disclosed in the U.S. Pat. No. 2,756,142. These components may have a solublizing group, if desired Examples of the moiety -Col may include the moieties represented by the following formulas (IV)-(IX).

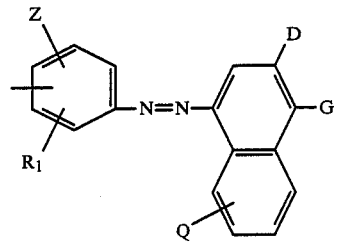

(IV)

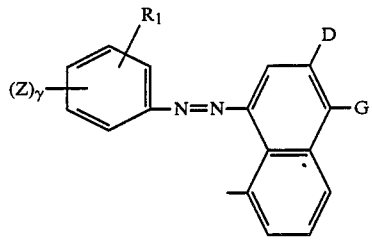

(V)

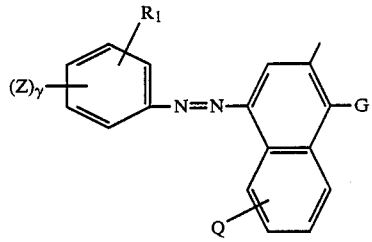

(VI)

In formulas (IV) to (VI), Q is at the 5 or 8 position relative to G and represents a hydroxyl group, or a group of —$NHCOR^3$ or —$NHSO_2R^3$ wherein $R^3$ represents an alkyl group having 1 to 6 carbon atoms, a substituted alkyl group having 1 to 6 carbon atoms, a benzyl group, a phenyl group or a substituted phenyl group having 6 to 9 carbon atoms; G represents a hydroxyl group or a salt thereof, or a hydrolyzable acyloxy group represented by the formula

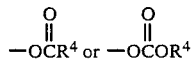

(wherein $R^4$ represents an alkyl group having 1 to 18 carbon atoms, a pheny group or a substituted phenyl group having 6 to 18 carbon atoms); r represents an integer of 1 or 2, Z represents a cyano group, a trifluoromethyl group, a fluorosulfonyl group, a carboxy group, a carboxylic acid ester group represented by the formula —$COOR^4$ (wherein $R^4$ has the same meanings as defined above), a nitro group at the 2 or 8 position relative to the azo bond, a fluorine, chlorine or bromine atom, an alkyl- or substituted-alkylsulfonyl group having 1 to 8 carbon atoms, a phenyl- or substituted-phenylsulfonyl group, an alkylcarbonyl group having 2 to 5 carbon atoms, a sulfamoyl group represented by the formula —$SO_2NR^5R^6$ wherein $R^5$ represents a hydrogen atom, an alkyl or substituted alkyl group having 1 to 8 carbon atoms; and $R^6$ represents a hydrogen atom, an alkyl or substituted-alkyl group having 1 to 6 carbon atoms, a benzyl group, a phenyl or substituted phenyl group having 6 to 9 carbon atoms, an alkyl- or substituted alkylcarbonyl group having 2 to 7 carbon atoms, a phyenyl- or substituted-phenylcarbonyl group having 7 to 10 carbon atoms, an alkyl- or substituted-alkylsulfonyl group having 1 to 6 carbon atoms, a phenyl or substituted-phenylsulfonyl group having 6 to 9 carbon atoms, or $R^5$ and $R^6$ may form, together with the nitrogen atom to which they are attached, a morpholino group or a piperidino group, or a carbamoyl group represented by the formula —$CON(R^5)_2$ wherein $R^5$s may be the same or different and have the same meaning as defined above; $Z^1$ represents a hydrogen atom or Z; $R^1$ represents a hydrogen atom, an alkyl group having 1 to 4 carbon atoms, a substituted alkyl group having 1 to 4 carbon atoms, an alkoxy group having 1 to 4 carbon atoms or a halogen atom; D represents a cyano group, a sulfo group, a fluorosulfonyl group, a halogen atom, an —$SO_3$-phenyl group or a substituted —$SO_3$-phenyl group having 6 to 9 carbon atoms, an alkyl- or substituted-alkyl-sulfonyl group having 1 to 8 carbon atoms, a phenyl- or substituted-phenylsulfonyl group having 6 to 9 carbon atoms, an alkyl- or substituted alkyl-sulfinyl group having 1 to 8 carbon atoms, a phenyl- or substituted-phenylsulfinyl group having 6 to 9 carbon atoms, a sulfamoyl group represeted by the formula —$CON(R^5)_2$ wherein $R^5$ and $R^6$ have the same meanings as defined above with respect to Z, provided that more than 1 sulfo groups or more than 1 carboxyl groups exists in the compound.

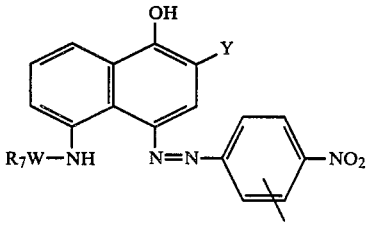

(VII)

-continued

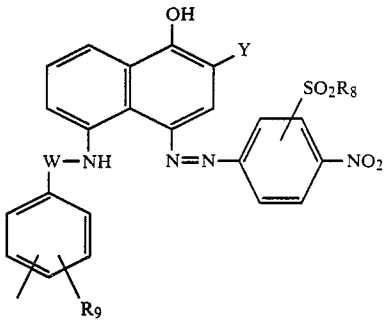

(VIII)

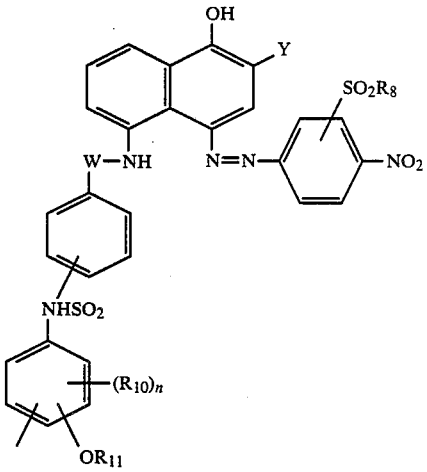

(IX)

In formulas (VII) to (IX), Y represents a hydrogen atom, a group

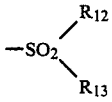

or a group

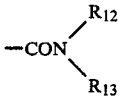

wherein $R_{12}$ represents a hydrogen atom, an alkyl group having 1 to 8 carbon atoms or an aryl group, and $R_{13}$ represents an acyl group, a hydroxyalkyl group, an alkoxyalkyl group, an alkoxyalkyleneoxyalkyl group, a carboxyalkyl group, a carboxyphenyl group, a carboxyalkylphenyl group, a hydroxyalkylphenyl group or an alkoxyphenyl group, or the same group as defined for $R_{12}$. W represents —CO— or —$SO_2$—, and $R_7$ represents an alkyl group having 1 to 6 carbon atoms, an aryl group or a group

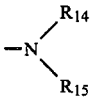

wherein $R_{14}$ and $R_{15}$ each represent a hydrogen atom, an alkyl group having 1 to 8 carbon atoms or an aryl group with the proviso that $R_{14}$ and $R_{15}$ should not simultaneously be a hydrogen atom.

$R_8$ represents a alkyl group having 1 to 6 carbon atoms or an aryl group having 6 to 10 carbon atoms.

$R_9$ represents a hydrogen atom, a halogen atom, an alkyl group having 1 to 4 carbon atoms, an alkoxy group having 1 to 8 carbon atoms or a dialkylamino group having 1 to 8 carbon atoms; and $R_{10}$ represents an alkyl group having 1 to 8 carbon atoms, an alkylthio group having 1 to 8 carbon atoms, an arylthio group, a halogen atom or an acylamino group having 1 to 10 carbon atoms.

n represents 0, 1 or 2.

$R_{11}$ represents an alkyl group having 1 to 6 carbon atoms or an aromatic group such as a phenyl group.

Next, specific representative examples for the non-diffusible green absorptive dye and the non-diffusible red absorptive dye to be used in the present invention will be shown below, to which however the compounds to be used in the present invention should not be limited.

A-1

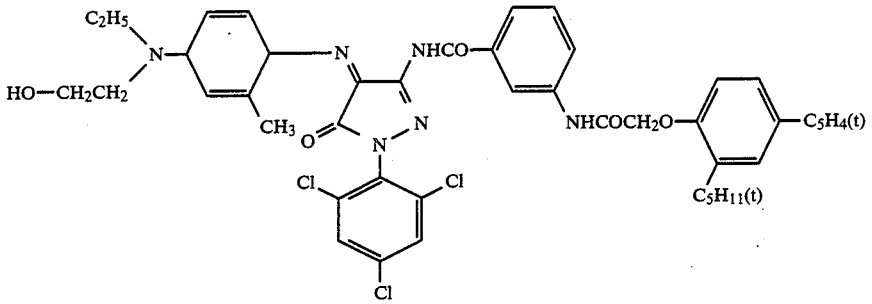

A-2

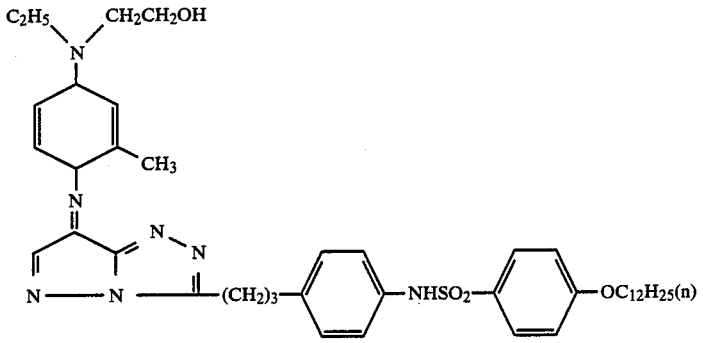

A-3

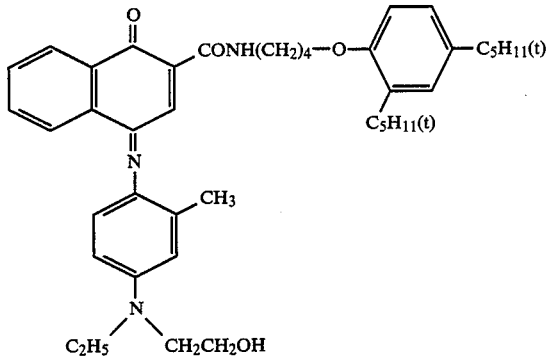

A-4

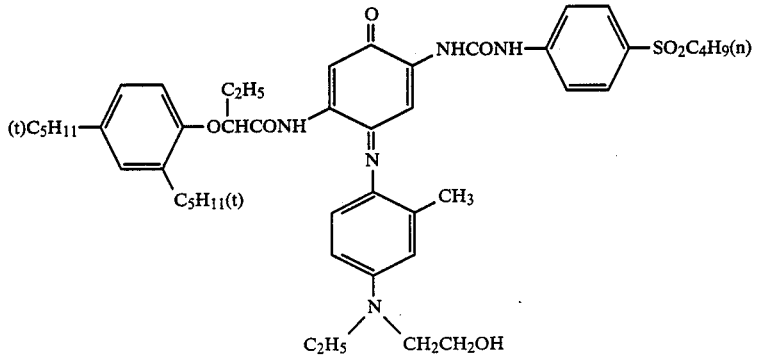

-continued
A-5
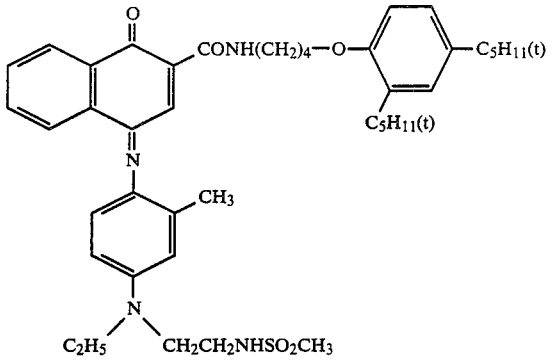
A-6
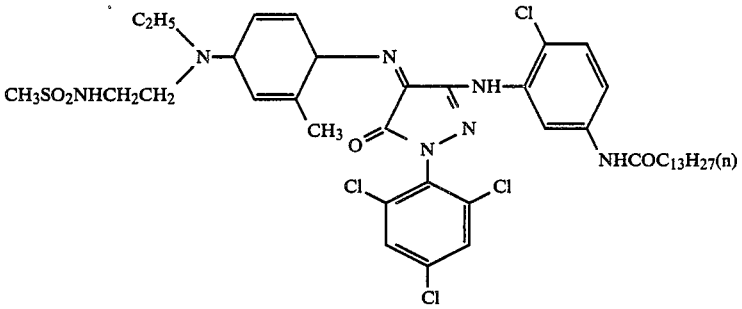
A-7
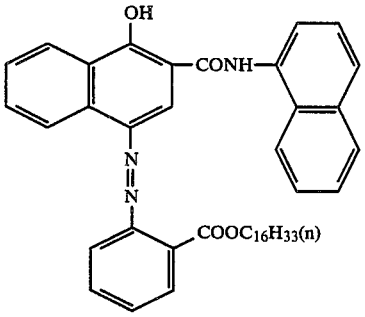
A-8
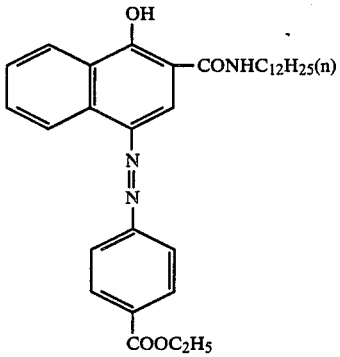
A-9
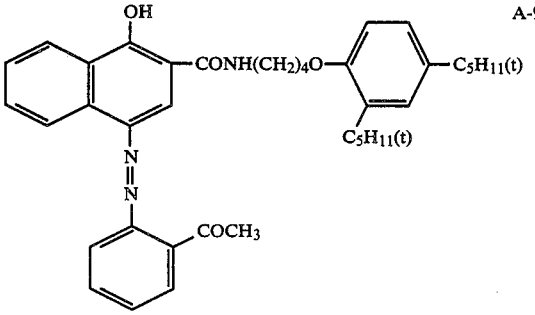
A-10
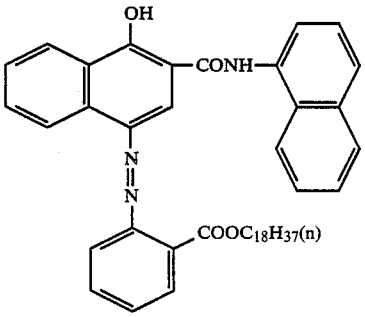

-continued
A-11
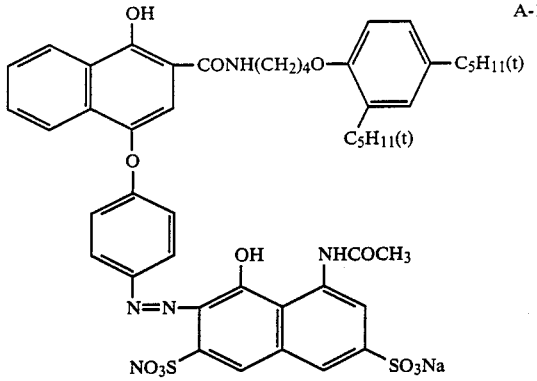
A-12
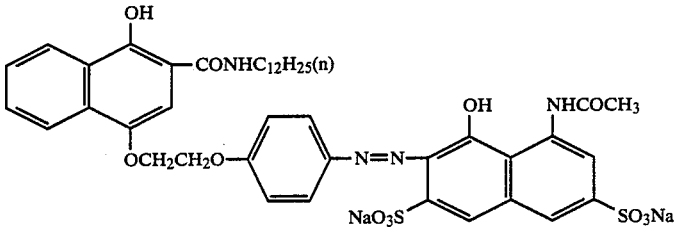
A-13
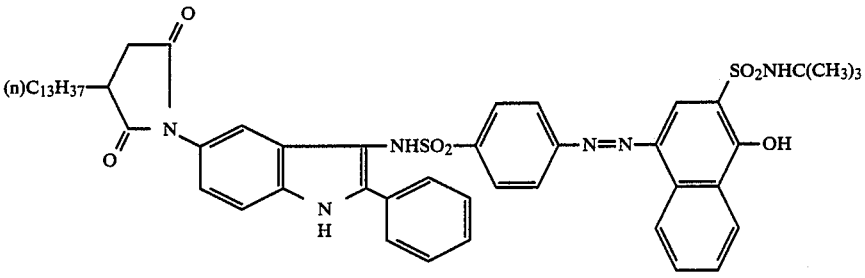
A-14
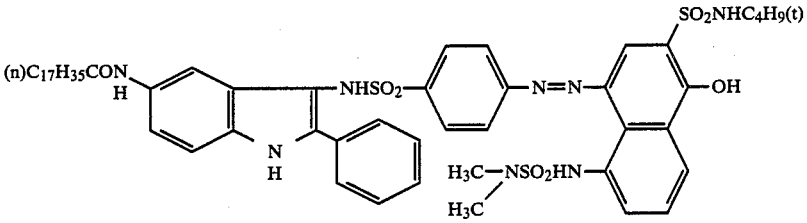
A-15
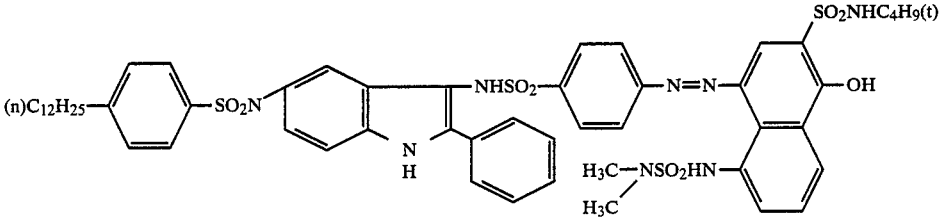

-continued
A-16
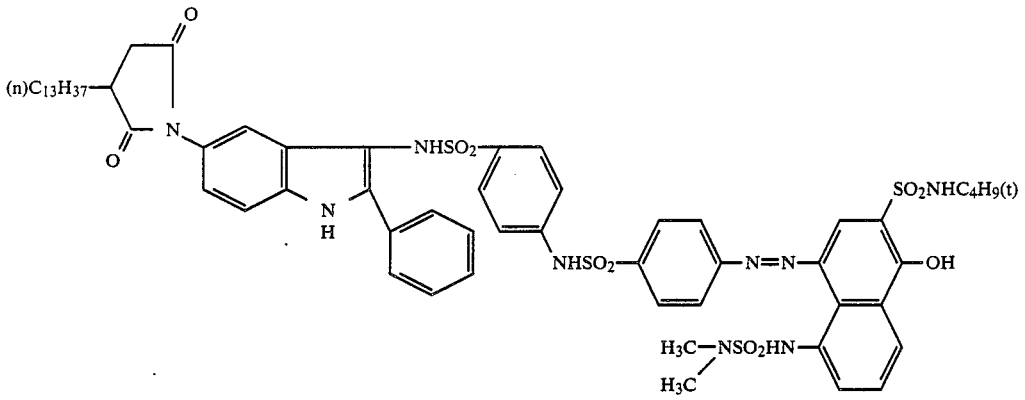
A-17
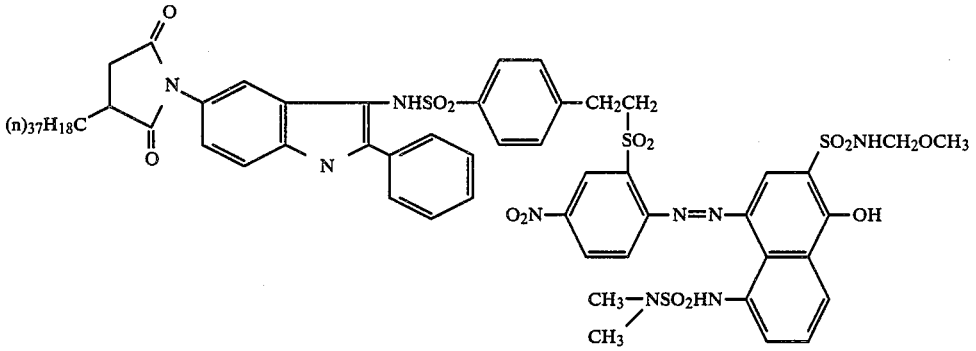
A-18
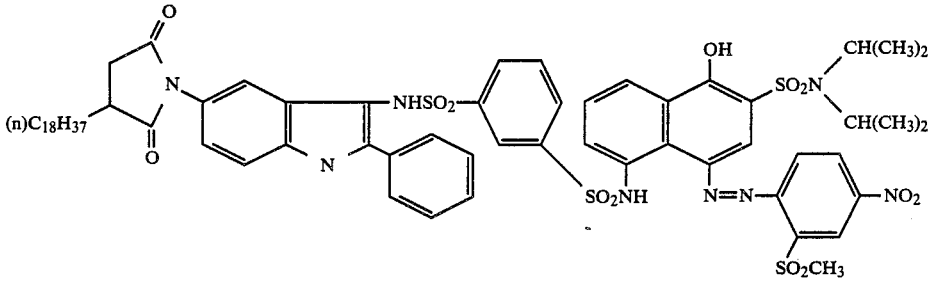
A-19
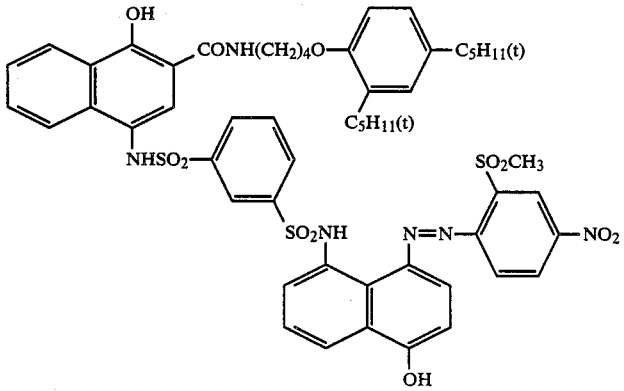

-continued
A-20
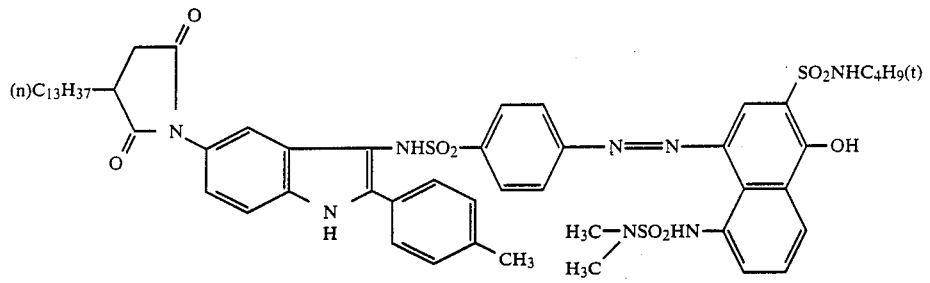
A-21
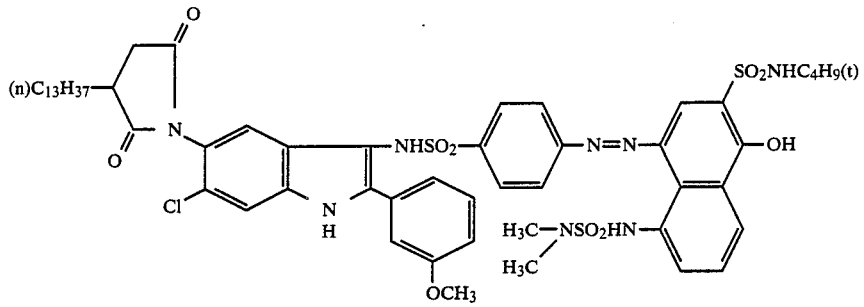
A-22
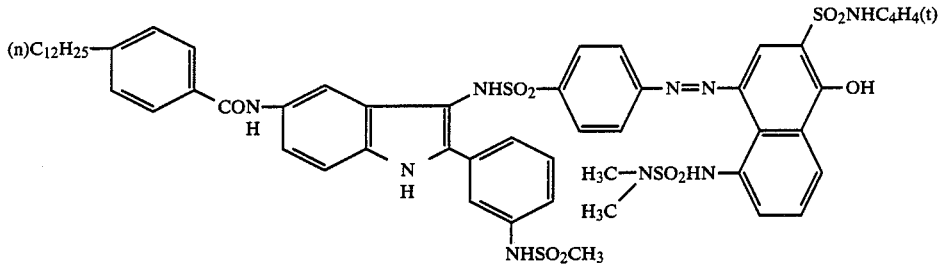
A-23
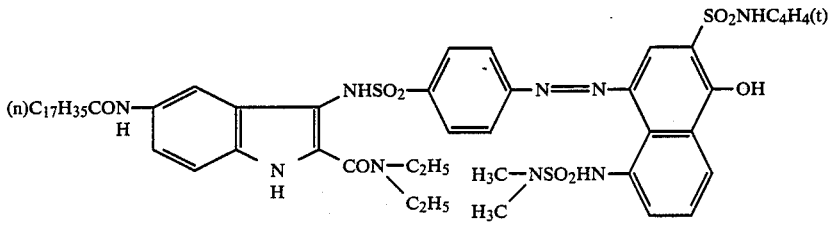
A-24
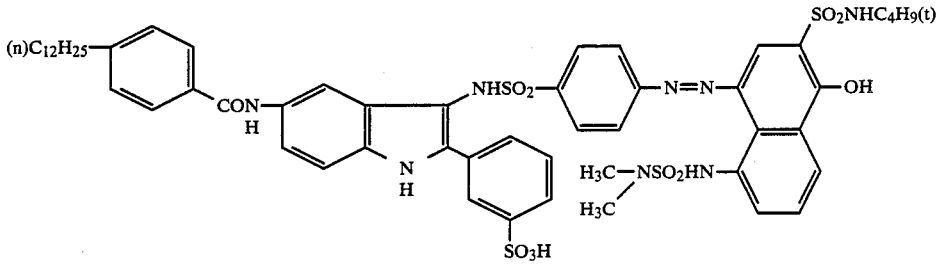
A-25
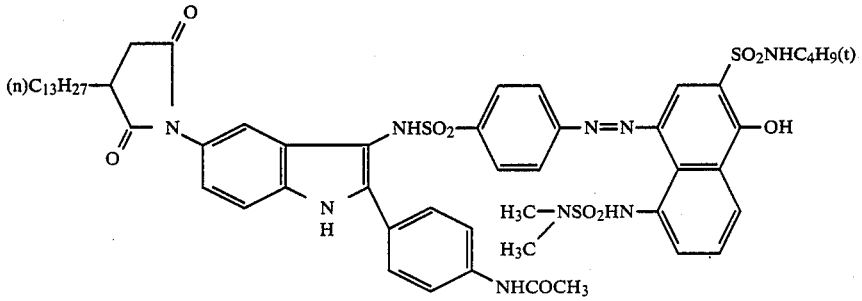

-continued
A-26
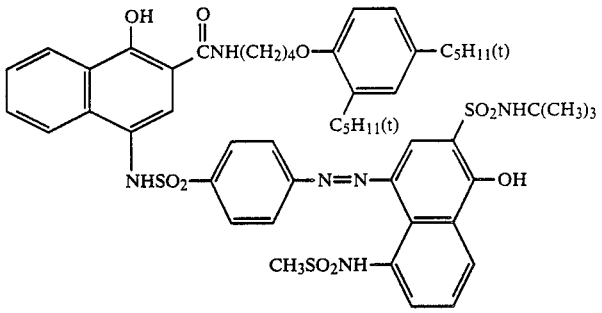
A-27
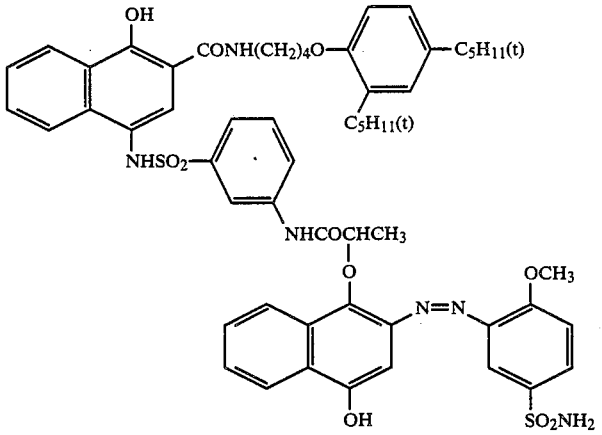
A-28
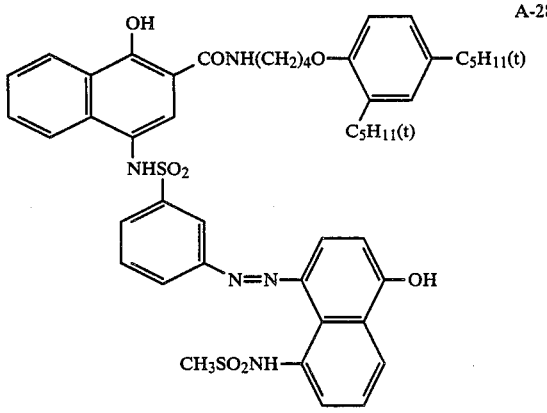
A-29
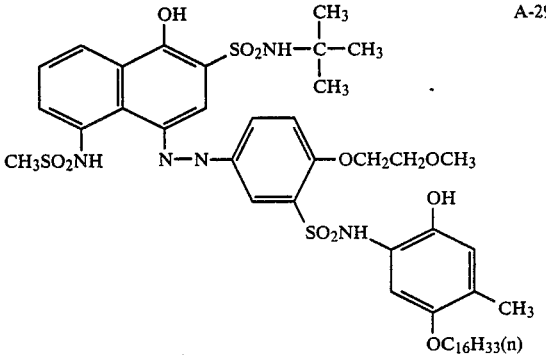
A-30
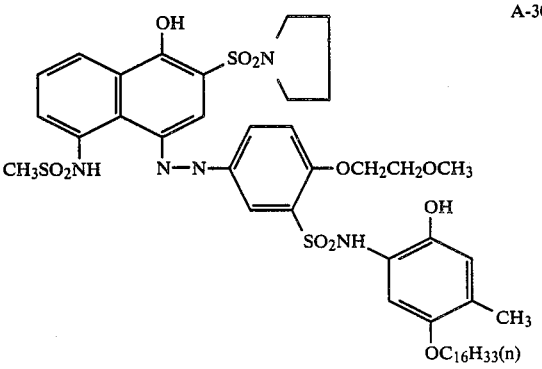
A-31
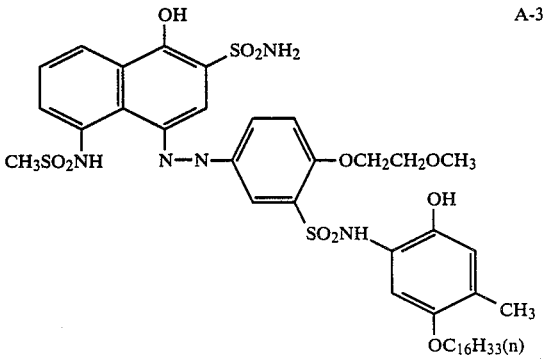

-continued
A-32
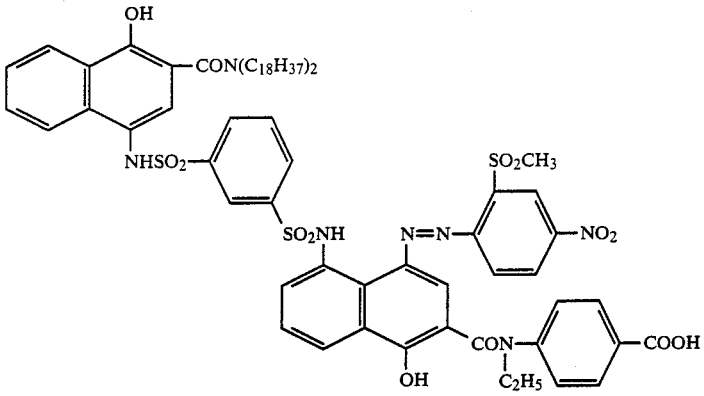
A-33
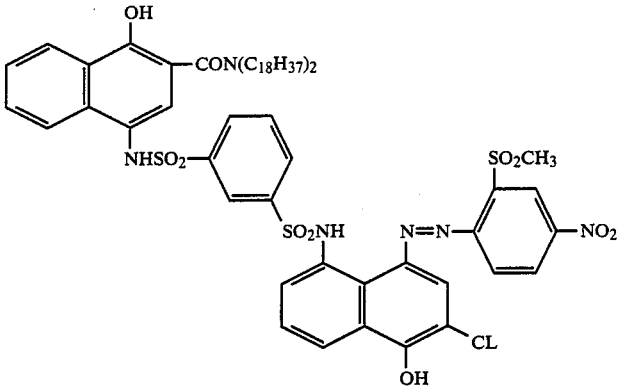
A-34
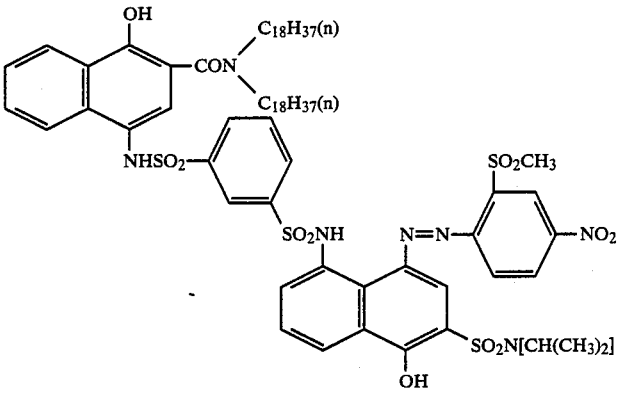
A-35
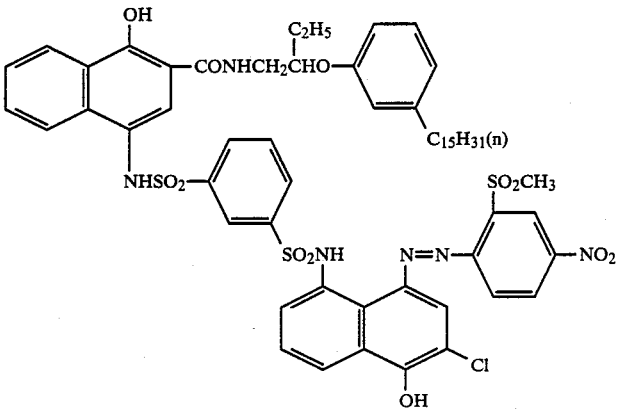

-continued
A-36
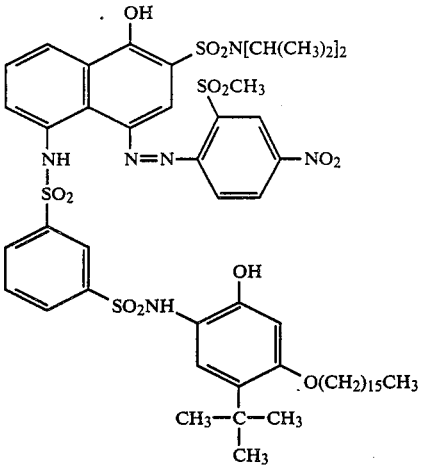
A-37
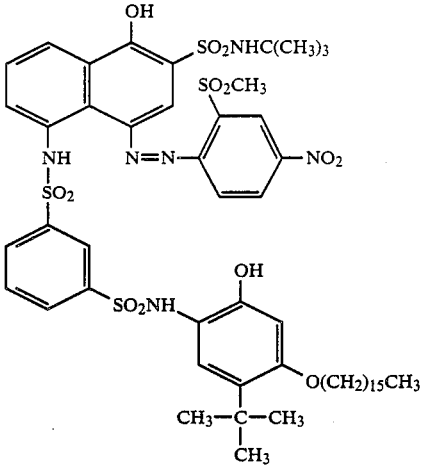
A-38
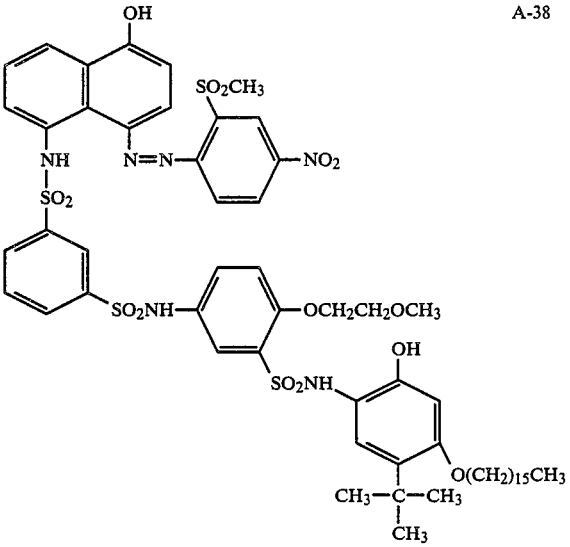
A-39
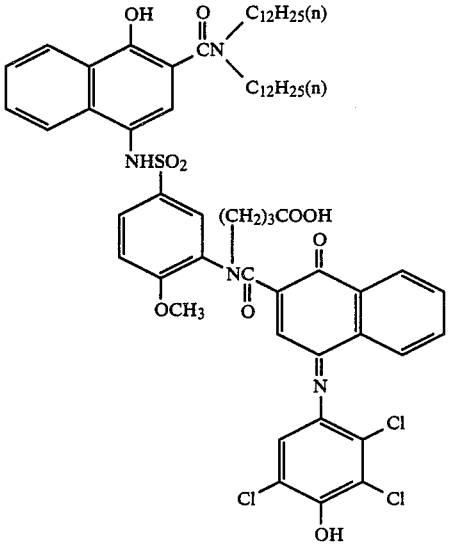
A-40
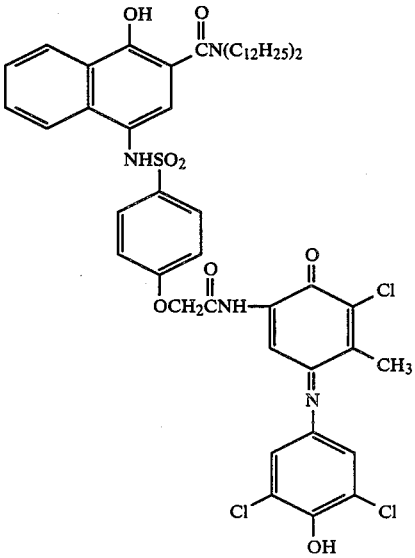
A-41
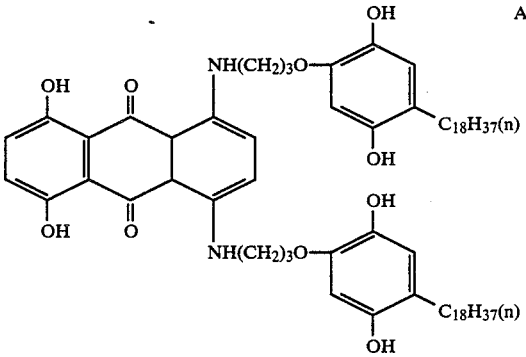

-continued
A-42
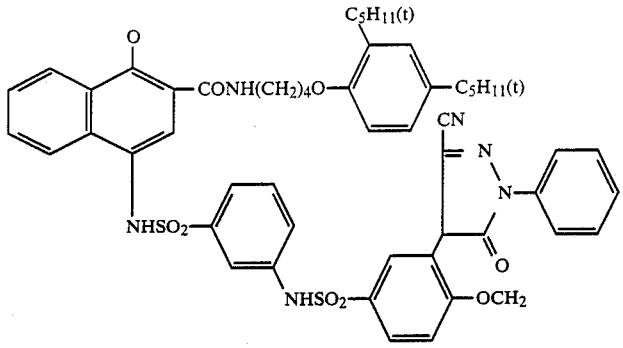
A-43
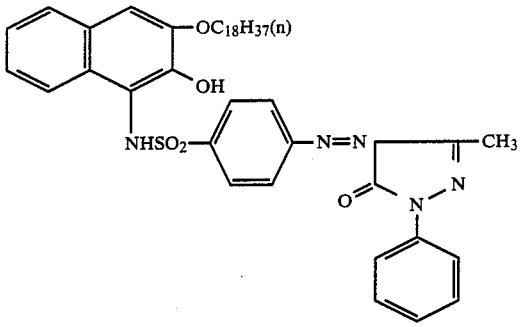
A-44
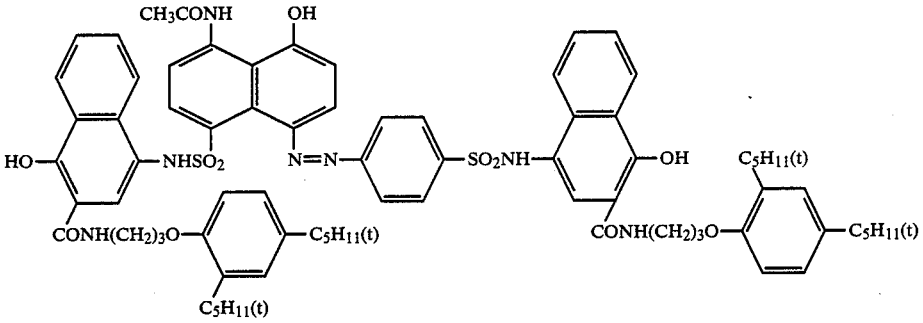
A-45
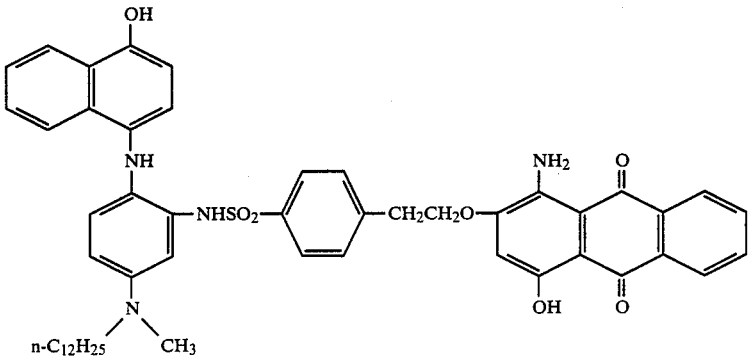

-continued

A-46

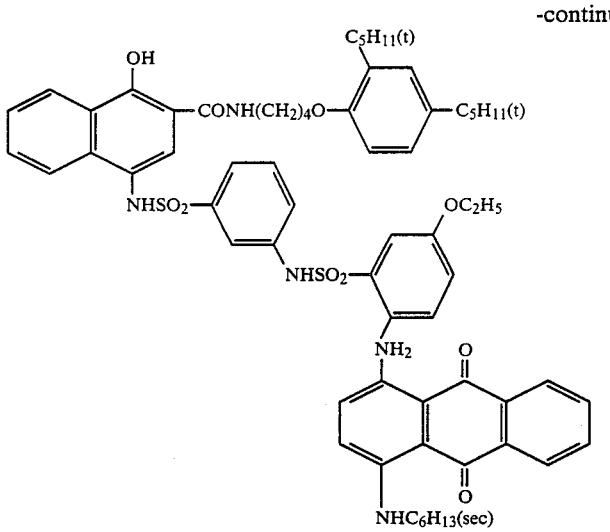

The non-diffusible dye of the present invention may be synthesized by known methods such as those disclosed in Japanese Provisional Patent Publication (Japan KOKAI) Nos. 33826/1973, 115528/1975, 50736/1978, 54021/1979 and 99431/1979, and U.S. Pat. No. 4,053,312.

The non-diffusible green absorptive dye and the non-diffusible red absorptive dye according to the present invention may preferably be employed by dissolving them in a mixture of a known high boiling point organic solvent and a low boiling point organic solvent represented by methyl acetate, ethyl acetate, propylacetate, butyl acetate, cyclohexane, tetra-hydrofuran, carbon tetrachloride, chloroform and so on; mixing the resulting solution with an aqueous gelatin solution containing a surfactant; and then emulsifying and dispersing the mixture by using such a dispersing means as a stirrer, a homogenizer, a colloid mill, a flow-jet mixer, a ultrasonic dispersing apparatus and the like, followed by incorporating the resultant mixture in a coating composition for a light-insensitive hydrophilic colloidal layer.

As the known organic solvent having high boiling point, there may be used organic acid amides, carbamates, esters, ketones, urea derivatives and so on, particularly, pathalic acid esters such as dimethyl phtalate, diethyl phthalate, dipropyl phthalate, dibutyl phthalate, di-n-octyl phthalate, di-isooctyl phthalate, diamyl phthalate, dinonyl phthalate, di-isodecyl phthalate and so on; phospholic acid esters such as tricresyl, phosphate, triphenyl phosphate, tri-(2-ethylhexyl) phosphate, tri-isononyl phosphate and so on; sebacic acid esters such as diotyl sebacate, di-(2-ethylhexyl) sebacate, diisodecyl sebacate and so on; glyceryl esters such as glycerol tripropionate, glycerol tributyrate and so on; and others including adipic acid esters, glutaric acid esters, succinic acid esters, maleic acid esters, fumaric acid esters, citric acid esters, and phenol derivatives such as di-tert-amylphenol, n-octylphenol and so on. These solvents may be employed alone or in combination.

The particularly preferred diffusible DIR compounds used in this invention are those wherein Y in general formula (1) is the group (timing group) represented by general formula (6).

Further, the diffusible DIR compound to be used in the present invention may be incorporated in an optional emulsion layer or layers of the group of said red sensitive emulsion layers and/or the group of said green sensitive emulsion layers, and may preferably be incorporated in a silver halide emulsion layer having lower sensitivity to obtain much more remarkable effect.

In the light-sensitive silver halide color photographic material according to the present invention, the amount of the diffusible DIR compound to be used may preferably be within a range of 0.0005 to 0.05 mole, more preferably of 0.001 to 0.01 mole per one mole of the silver halide in the emulsion.

The non-diffusible green absorptive dye and the non-diffusible red absorptive dye to be used in the present invention may preferably be employed by being incorporated in a light-insensitive hydrophilic colloidal layer (filter layer) after having dissolved the oil-soluble dye in a known high boiling point organic solvent followed by emulsification and dispersion, as mentioned above.

The non-diffusible dye to the incorporated in the filter layer may be used in such an amount that the transmission density of the filter layer may generally be 0.01 to 0.3, preferably 0.03 to 0.1 when measured with a light of a wave-length corresponding to the color sensitivity in the red spectral region (600–700 nm) of a red sensitive emulsion layer with respect to the red absorptive filter layer and with a light of a wavelength corresponding to the color sensitivity in the green spectral region (500–600 nm) of a green sensitive emulsion layer with respect to the green absorptive filter layer.

Especially preferred position of the red absorptive filter layer is a light-insensitive aqueous colloidal layer which is adjacent to and on the opposite side, when viewed from a support, of the red sensitive emulsion layer closest to the support.

Especially preferred position of the green absorptive filter layer is a light-insensitive aqueous colloidal layer which is adjacent to and on the opposite side, when viewed from a support, of the green sensitive emulsion layer closest to the support.

The red absorptive filter layer may optionally absorb any light outside the red spectral region, and the green absorptive filter layer may absorb optionally any light outside the green spectral region. Preferably, however, the light absorption outside the red spectral region for the former and the light absorption outside the green spectral region for the latter should be as little as possible so that the property of each light-sensitive layer may optionally be changed independently when a color light-sensitive material is designed.

In the present invention, the red absorptive filter layer and the green absorptive filter layer may also take the form of a filter layer which exhibits their functions in a single layer to absorb both of red and green lights.

For the layer constitution of the color light-sensitive material according to the present invention, known layer constitution may be adopted. Applicable layer constitutions include those as described in West German Pat. No. 11 21 470; U.S. Pat. Nos. 3,658,536, Japanese Patents Publications (KOKOKU) Nos. 15495/1973 and 37018/1978; and Japanese Provisional Patents Publications (KOKAI) 79333/1975 and 155536/1982.

In the color light sensitive material of the present invention, other known couplers may be used in combination with the DIR compound which reacts with an oxdided form of said color deveoping agent to release a diffusive developing inhibitor or a precursor thereof as well as the non-diffusible dye. As these couplers, there may be mentioned a magenta coupler, a yellow coupler and a cyan coupler. As the magenta coupler, there may particularly be mentioned a pyrazolon type, a pyrazolotriazole type, a pyrazolinobezimidazol type and indazolon type couplers. As such a magenta coupler, there may be mentioned those disclosed in U.S. Pat. Nos. 2,600,788, 2,983,608, 3,062,625, 3,127,269, 3,311,476, 3,419,391, 3,519,429, 3,558,319, 3,582,322, 3,615,506, 3,834,908, and 3,891,445; West German Pat. No. 18 10 464; West German Offenlegungsschrift (OLS) Nos. 24 08 665, 24 17 945, 24 18 959, and 24 24 467; Japanese Patent Publication (KOKOKU) No. 6031/1965, Japanese Provisional Publications (KOKAI) Nos. 74027/1974, 74028/1974, 129538/1974, 60233/1975, 20826/1976, 26541/1976, 42121/1977, 58922/1977 and 55122/19787; and Japanese Patent Application No. 110943/1980. Among these magenta couplers, a colord coupler which is arylazo substituted or heteroarylazo substituted at an active point of a colorless magenta coupler may be employed, which are exemplified in U.S. Pat. Nos. 2,455,170, 2,688,539, 2,983,608, 3,005,712, and 3,519,429; British Pat. Nos. 800,262, 1,044,778; Belguium Pat. No. 676,691; and so on.

Further, as the yellow coupler, there may be mentioned benzoylacetanilide type and pivaloylacetanilide type yellow couplers. Moreover, there may further be mentioned a two equivalent yellow coupler in which the carbon atom at the coupling site is substituted by a substituent capable of being eliminated at the time of coupling.

Specific examples for the yellow coupler to be used in the present invention include those disclosed in U.S. Pat. Nos. 2,875,057, 3,265,506, 3,408,194, 3,725,072, and 3,891,445; West German Pat. No. 15 47 868; West German Offenlegungsschrift Nos. 22 19 917, 22 61 361, and 24 14 006; British Pat. No. 1,425,020; Japanese Patent Publication (KOKOKU) No. 10783/1976; Japanese Provisional Patent Publication (KOKAI) Nos. 26133/1972, 73147/1973, 6341/1975, 87650/19751, 123342/1975, 130442/1975, 21827/1976, 102636/1976, 82424/1977, 115219/1977, and 95346/1983;

As the cyan coupler, there may be mentioned a phenol or naphthol derivatves. Further, as the colored cyan coupler, there may be mentioned a compound in which a colorless cyan coupler is substituted by a phenoxy group which has been arylazo substituted directly or through an alkoxy group at the coupling site.

As such cyan couplers, there may preferably be mentioned those disclosed in U.S. Pat. Nos. 2,423,730, 2,474,293, 2,801,171, 2,895,826, 3,476,563, 3,737,326, 3,758,308, and 3,893,044; Japanese Provisional Patent Publications (KOKAI) Nos. 37425/1972, 10135/1975, 25228/1975, 112038/1975, 117422/1975, 130441/1975 and 98731/1983. Furthermore, colored cyan couplers as musking couplers may include, for example those compounds described in U.S. Pat. Nos. 2,521,908, and 3,034,892; British Pat. No. 1,255,111; Japanese Provisional Patent Publication (KOKAI) No. 22028/1973 and so on.

In addition, there may also be employed a colored cyan coupler of a type in which a dye is released to a processing bath by the reaction with an oxidized product of a color developing agent, as described in U.S. Pat. No. 3,476,563, Japanese Provisional Patent Publication (KOKAI) Nos. 10135/1975 and 123341/1975.

The conventionally known magenta couplers, yellow couplers and cyan couplers to be used in the present invention may be employed in an amount of 0.002 to 0.5 mol, preferably 0.009 to 0.35 mol per 1 mol of silver halide, when they are incorporated in a light-sensitive layer in combination with the diffusible DIR compound of the present invention.

In the color light-sensitive material according to the present invention, there may be used a ureid type phenol series cyan coupler having a phenyl ureid group, a naphtyl ureid group or a hetrocyclic ureid group at the 2 position and an acylamino group at the 5 position in combination with the diffusion DIR compound or a precursor thereof. Such a ureid type phenol series cyan coupler has been described in Japanese Provisional Patent Publication (KOKAI) Nos. 65134/1981, 204543/1982, 204544/1982 and 204545/1982. In cases where said ureid type phenol series cyan coupler is employed in combination with the diffusible DIR compound according to the present invention, the layer in which the cyan coupler is to be incorporated may be the same as or different from the layer containing the above-mentioned DIR compound. When a ureid typed cyan coupler is used in combination with the diffusible DIR compound according to the present invention, the color-return failure of a cyan dye which is liable to occur when the bleaching ability at the time of a bleaching treatment is lowered may be improved to afford a dye image having a good color balance.

Furthermore, in the present invention, in order to improve the granularity of a dye image, there may be employed a coupler, in combination with the diffusible DIR compound of the present invention, a coupler in which a dye produced upon the coupling reaction with an oxidized form of a color developing agent becomes slightly mobile. Such a coupler has been described, for example, in Japanese Provisional Patent Publication (KOKAI) No. 82837/1982 and 217932/1983; Japanese Patent Application No. 174755/1983, and so on, and is non-diffusible in an emulsion. This coupler may be added to a layer which the same or different from the layer in which is the diffusible DIR compound of the present invention is incorporated. However, it may preferably be incorporated in a highly sensitive layer among a plural number of silver halide emulsion layers having substantially the same color sensitivity and different light sensitivities. The amount of the coupler to be added is 0.001 to 0.5 $g/m^2$, preferably 0.005 to 0.5 $g/m^2$.

For the silver halide emulsion to be used in the color light-sensitive material according to the present invention, there may be employed any optional silver halide such as silver bromide, silver iodobromide, silver chlorobromide and silver chloride which are used in usual silver halide emulsions.

The silver halide grains to be used in the silver halide emulsion may be obtained by any method of the method under acidic condition, the method under neutral condition and the ammonia method. The grains may be grown simultaneously at a time or may be grown after seed grains are formed. The method for forming the seed grains may be the same as or different from the method for growing the seed grains.

The silver halide emulsion may be prepared by admixing simultaneously halide ions and the silver ions with each other or by adding either ones to a solution containing the other. Further, silver halide cristals may also be grown by sequentially or simultaneously adding halide ions and silver ions to a mixing vessel while controlling the a pH and/or pAg taking into consideration the cristal growth rate of the silver halide cristals. According to this method, silver halide grains having regular cristal forms and approximately uniformed grain size may be obtained. The halogen composition of the grains may also be varied after growth thereof by the conversion method.

In the course of formation and/or growth of grains, metal ions may be added to the silver halide grains by using at least one selected from a cadmium salt, a zinc salt, a thallium salt, an iridium salt (including a complex salt), a rhodium salt (including a complex salt) and an iron salt (including a complex salt) thereby to incorporate these metallic elements inside the grains and/or on the surface of the grains. Further, reductively sensitized nuclei may be formed inside the grains and/or on the surface of the grains by placing them under an appropriate reductive atmosphere.

The silver halide emulsion may be free of unnecessary soluble salts or may contain them after completion of the growth of the silver halide grains. The removal of such salts may be carried out according to the method described in Research Disclosure (hereinafter referred to as RD) No. 17643, item II.

The silver halide grains may have uniform distribution of the silver halide composition inside the grains or may be core/shell type grains having different silver halide compositions between inside of the grains and on the surface layer thereof.

The silver halide grains may be either grains in which a latent image is formed mainly on the surface thereof or grains in which a latent image is formed mainly inside the grains.

The silver halide grains may have such a regular crystal form as cubic, octahedron, tetradecahedron, etc., or may have such an irregular crystal form as sphere, plate, etc. Grains having optional ratio of {100}face and }111}face may be employed. Grains having complex form of these crystal forms may also be used and mixtures of grains having various crystal forms may be employed.

There may be employed a silver halide emulsion having any grain size distribution. Either an emulsion having broad grain size distribution (referred to as polydisperse emulsion) or an emulsion having narrow grain size distribution (referred to as monodisperse emulsion). Here, the monodisperse emulsion means an emulsion in which the value obtained by dividing the standard deviation of the grain size distribution by the average grain size is not more than 0.20. The grain size is defined as the diameter when the grain is a spherical silver halide, and, in case of a grain other than a sperical one, the grain size is defined as the diameter of a circular image of which the area is the same as the projected area of the grain. These polydisperse emulsions or the monodisperse emulsions may be used in single or in combination of two or more kinds thereof. In addition, the polydisperse emulsion and the monodisperse may be used in combination.

There may be employed a silver halide emulsion prepared by mixing two or more kinds of a silver halide emulsions which have separately been formed.

The silver halide emulsion may be subjected to chemical sensitization according to conventional methods. Namely, the sulfur sensitization method, the selenium sensitization method, the reduction sensitization method, the noble metal sensitization method using gold or other noble metal compounds and the like may be used in single or in combination with each other.

The silver halide emulsion may be sensitized in an optional region of wave-length by using a dye which has been known as a sensitizing dye in the photographic business field. The sensitizing dye may be employed in single or in combination of two or more kinds thereof.

In addition to the sensitizing dye, a color-strengthening sensitizing which is a compound having no action of spectral sensitizer by itself or a compound absorbing substantially no visible light and which strengthen the sensitizing action of the sensitizing dye may be incorporated in the emulsion.

As the sensitizing dye, there may be employed a cyanine dye, a melocyanine dye, a complex cyanine dye, a complex melocyanine dye, a holopola-cyanine dye, a hemicyanine dye, a steryl dye, a hemioxonal dye and so on.

Especially useful dyes are a cyanine dye, a melocyanine dye and a complex melocyanine dye.

The silver halide emulsion may be incorporated with a compound known as an anti-fogging agent or a stabilizer in the photographic business field during chemical ripening, at the time of completion of chemical ripening or by the time of coating the silver halide emulsion for the purpose of preventing the light-sensitive material from fogging in the course of manufacturing thereof, during storage thereof or during photographic processing thereof, or of stabilizing the photographic performance thereof.

Incidentally, the reduction of the sensitivity due to the use of the DIR compound and the dye may be compensated by using a tablet (flat plate) silver halide emulsion having an average aspect ratio of 5 or higher. Here, the aspect ratio refers to a ratio of diameter to thickness of a grain, wherein the diameter of the silver halide grain refers to the diameter of a circle equal in area to the projected area of the grain. When a tablet silver halide emulsion is used in the present invention, the average aspect ratio may preferably be 6 to 100, more preferably 7 to 50 and most preferably 8 to 20. Further, preferred average diameter of the grains is 0.5 to 30 $\mu$m, more preferably 1.0–20 $\mu$m. It is preferred that the amount of the tablet silver halide grains is 40% by weight or more, particularly 60% by weight or more relative to the total silver halide grains in the layers containing the tablet silver halide emulsion.

As the silver halide for the tablet silve halide, there may be mentioned silver bromide, silver iodobromide, silver chloroiodobromide, silver chlorobromide, silver chloride and the like, with silver bromide and silver iodobromide being preferred. More preferred is silver iodobromide having a silver iodide content of 0–18 mole %, particularly preferably 4–12 mole %.

The tablet silver halide emulsion may be obtained according to the known methods disclosed in Japanese Provisional Patent Publication (KOKAI) Nos. 153428/1977, 155827/1979, 118823/1979, 127921/1983, 113928/1983 and so on.

Especially preferred tablet silver halide grain is a grain in which silver iodide is localized in the central portion or part of said silver iodobromide. The phase at the central portion, which contains higher amount of iodine, may preferably be 80% by volume or less, more preferably 60 to by 80% volume of the total volume of the grains.

The silver iodide content at the central portion may preferably be 5 to 40 mole %, more preferably 10 to 30 mole %.

The silver iodide content of the phase containing lower concentration of iodide, which surrounds the phase containing higher concentration of iodide at the central portion, may preferably comprise a silver iodolbromide having a silver iodide content of 0 to 10 mole %, more preferably 0.1 to 6.0 mole %.

A tablet silver halide emulsion, in which silver iodide is slightly localized at the central portion, may be obtained by the known method disclosed in Japanese Provisional Patent Publication (Japan KOKAI) No. 99433/1984 and so on.

As a binder (or a protective colloid) for the silver halide emulsion, gelatin may advantageously be employed. However, a hydrophilic colloid such as a gelatin derivative, a graft polymer of gelatin with other polymer, other proteins than gelatin, a sugar derivative, a cellulose derivative, a synthetic hydrophilic polymer substance including a homopolymer or a copolymer, and so on may also be employed.

The photographic emulsion layer and other hydrophilic colloidal layers in the light-sensitive material of the present invention may be hardened by using one or more kinds of hardening agents (hardeners) capable of crosslinking the binder molecules to enhance the film strength thereof. The hardener may be added to the light-sensitive material in such an amount that it need not be added in a processing solution and the light-sensitive material can be hardened. It is also possible to add the hardener to a processing solution.

The silver halide emulsion layer and/or other hydrophilic colloidal layer of the light-sensitive material may be incorporated with a plasticizer for the purpose of enhancing the flexibility thereof. Preferable plasticizer is the compound described in RD No. 17643, item XII-A.

The photographic emulsion layer and other hydrophilic colloidal layer of the light-sensitive material may be incorporated with a dispersion (latex) of a synthetic polymer which is insoluble or hardly soluble in water, for the purpose of improving the dimensional stability thereof and so on.

In the emulsion layers of the light-sensitive material, there may be employed a yellow-dye-forming coupler for the blue-sensitive emulsion layer; a magenta-dye-forming coupler for the green-sensitive emulsion layer and a cyan-dye-forming coupler for the red-sensitive emulsion layer. However, the light-sensitive silver halide color photographic material may also be prepared by using different combinations than the above-mentioned ones, depending upon the purpose.

These dye-forming couplers include compounds capable of releasing, by the coupling with an oxidized form of a developing agent, a photographically useful fragment such as of a non-diffusible development inhibitor, a development accelerator, a bleaching accelerator, a developing agent, a solvent for silver halide, a color-regulating agent, a hardener, a fogging agent, an anti-fogging agent, a chemical sensitizer, a spectral sensitizer and a desensitiaing agent. Among these couplers, there may also be employed a DIR compound capable of releasing a non-diffusible development inhibitor simultaneously with the formation of a colorless compound by the coupling reaction with an oxidized form of a developing agent, in place of a coupler capable of releasing a non-diffusible development inhibitor with the progress of the development.

These DIR couplers and DIR compounds include ones in which a development inhibitor is bonded directly to the coupling site and ones in which an inhibitor is bonded to the coupling site through a divalent group in such a manner that the inhibitor is released by a intramolecular nucleophilic reaction or a intramolecular charge-transfer reaction in the moiety eliminated by the coupling reaction (Such a DIR coupler and a DIR compound should be referred to as "timing DIR coupler" and "timing DIR compound", respectively).

A colorless coupler (referred to also "competitive coupler") capable of coupling with an oxidized form of a developing agent belonging to an aromatic primary amine and forming no dye may be used in combination with a dye-forming coupler.

Among dye-forming couplers, colored couplers, DIR couplers, DIR compounds, image stabilizers, color-fogging preventing agents, ultraviolet absorbers, fluorescent brightening agents and so on which are not necessarily adsorbed on the surface of silver halide crystals, hydrophobic compounds may be dispersed by using various methods such as the solid dispersion method, the latex dispersion method, the oil-in-water type emulsifying dispersion method and so on, of which a suitable method may be selected in accordance with the chemical structure, etc. of the hydrophobic compound such as a coupler, etc. To the oil-in-water type emulsifying dispersion method, there is applicable a conventionally known method for dispersing a hydrophobic additive such as a coupler, in which the substance to be dispersed may be dissolved ordinarily in a high boiling point organic solvent having a boiling point of not less than around 150° C., in optional combination with a low boiling point and/or water-soluble organic solvent as occasion demands; emulsified and dispersed in a hydrophilic binder such as an aqueous gelation solution by using a surfactant by way of such a dispersion means as a stirrer, a homogenizer, a colloid mill, a flow-jet mixer, a ultrasonic apparatus, etc.; and then added to the object hydrophilic colloidal solution.

A step for removing the low boiling point organic solvent simultaneously with or after dispersion may be added.

As the high boiling point solvent, there may be employed organic solvents such as phenol derivatives, phthalic acid alkyl esters, phosphoric acid esters, citric acid esters, benzoic acid esters, alkylamides, aliphatic acid esters, trimesic acid esters and so on.

Low boiling point solvents or aqueous organic solvents may be used with high boiling point solvents or instead of high boiling point solvent. As the substantially water-insoluble organic solvent having a low boiling point, there may be mentioned ethyl acetate, propyl acetate, butyl acetate, butanol, chloroform, carbon tetrachloride, nitromethane, nitroethane, benzene and so on. Furhter, as the aqueous organic solvent, there may be exemplified acetone, methyl isobutyl ketone, β-ethoxyethyl acetate, methoxyglycol acetate, methanol, ethanol, acetonitrile, dioxane, dimethylformamide, dimethyl sulfoxide, hexamethylphosphoric triamide, diethyleneglycolmonophenyl ether, phenoxyethanol and so on.

In cases where the dye-forming coupler, the DIR coupler, the colored coupler, the DIR compound, the image stabilizer, the color-fogging preventing agent, the ultraviolet absorber, the fluorescent brightener, etc. have such an acidic group as in a carboxylic or sulfonic acid, such substances may also be introduced as a basic aqueous solution in the hydrophilic colloid.

The hydrophobic compound is dissolved in a low boiling point solvent itself or in a mixture thereof with the high boiling point solvent. As a dispersing aid for dispersing the resultant solution in water by using a mechanical or ultrasonic means, there may be employed an anionic surfactant, a nonionic surfactant, a cationic surfactant and an amphoteric surfactant.

In order to prevent color tubidity from occurring; the sharpness from being deteriorated; and the granularity from getting marked by the migration of an oxidized form of a developing agent or a charge-transfer agent between emulsion layers (between emulsion layers having the same color sensitivity and/or between emulsion layers having different color sensitivities) of the light-sensitive material, there may be employed a color-fogging preventing agent.

Said color-fogging preventing agent may be incorporated in the emulsion layer itself or may be incorporated in an intermediate layer provided between adjacent emulsion layers.

In the light-sensitive material, there may be used an image stabilizer capable of preventing a dye image from being deteriorated. A compound which can preferably be employed is described in RD No. 17643, item VII-J.

The hydrophilic colloidal layer such as protective layer, intermediate layer of the light-sensitive material may be incorporated with a ultraviolet absorber in order to prevent the light-sensitive material from fogging by discharging due to being charged with electricity by friction etc, and the image from being deteriorated by a ultraviolet light.

In order to prevent the magenta-dye-forming coupler etc. of the light-sensitive material from being deteriorated by formalin during storage, there may be employed a formalin scavenger in the light-sensitive material.

In cases where the hydrosphilic colloidal layers of the light-sensitive material are to be incorporated with a dye, a ultraviolet absorber and so on, these may be mordanted with a mordant such as a cationic polymer.

The silver halide emulsion layers and/or other hydrophilic colloidal layers of the light-sensitive material may be incorporated with a compound capable of changing the developability such as a development accelerator, a development restrainer, etc. and a bleaching accelerator. Compounds which may preferably be employed as the development accelerator are described in RD No. 17643, item XXI-B-D, and preferred compounds as development restrainers are described in RD No. 17643 item X-E. For the purpose of acceleration of development and other purposes, a black-and-white developing agent and/or its precursor may be employed.

The emulsion layers of the light-sensitive material may include, for the purpose of enhancing the sensitivity, enhancing the contrast and accelerating the development, a polyalkyleneoxide or its derivatives such as ethers, esters, amines thereof, etc.; a thioether compound; a thiomorpholin; a quaternary ammonium compound; a uretane derivative; a urea derivative; an imidazole derivative; and so on.

The light-sensitive material may be incorporated with a fluorescent brightening agent not only to accentuate the whiteness of a white substrate but also not to make prominent the coloring of the white portion on the substrate. Compounds which may preferably been employed as fluorescent brightening agents are described in RD No. 17643, item V.

The light-sensitive material may be provided with such an auxiliary layer as series of filter layers, for example, a blue absorptive filter layer, which are other than the red absorptive filter layer and the green absorptive filter layer according to the present invention; an antihalation layer; an antiirradiation layer; and so on. In these layers and/or emulsion layers, there may be included a dye which is flown out or released from the light-sensitive material. Such a dye includes an oxonol dye, a hemioxonol dye, a styryl dye, a melocyanine dye, a cyanine dye, an azo dye.

The silver halide emulsion layer and/or other hydrophilic colloidal layers of the light-sensitive material may be incorporated with a matting agent for the purpose of reducing the lustre of the light-sensitive material, improving the writability and preventing the light-sensitive material from adhering to each other.

The light-sensitive material may be incorporated with a lubricant in order to reduce the sliding friction.

The light-sensitive material may be incorporated with an antistatic agent for the purpose of prevention of charging with electricity. The antistatic agent may be incorporated either in an antistatic layer on the side of a support having no emulsion layer laminated, or in a protective colloid layer other than the emulsion layers on the side having laminated emulsion layers. Antistatic agents which may preferably be used are described in RD No. 17643, item XIII.

For silver halide emulsion layer and/or other hydrophilic colloidal layers of the light-sensitive material, there may be employed various kinds of surface active agents (surfactants) for the purpose of improvement in coatability, prevention of charging with electricity, improvement in lubricity, emulsifying dispersion, prevention of adhesion, improvement in photographic properties (such as development acceleration, film hardening, sensitization and so on) and so on.

In order to compensate the desensitization accompanying the use of the DIR compound and the dye, optional light-insensitive hydrophilic colloidal layer may preferably be incorporated with finely divided silver halide grains thereby to improve the treatment-stability as well.

At least one layer of the light-insensitive hydrophilic collidal layer containing finely divided silver halide grains may simultaneously be incorporated with the red absorptive dye and/or the green absorptive dye. Further, a part or the whole of these dyes may be incorporated in a different layer from the layer containing the finely divided silver halide grains with the latter case being preferred.

In this context, the finely divided silver halide grains refer herein to silver halide grains which is insensitive to the light at the time of imagewise exposure and is not substantially developed at the development processing, and which has not preliminarily been fogged.

This finely divided silver halide may contain 0 to 100 mole % of silver bromide, and as long as it is a silver halide which contains silver bromide in such a ratio, it may be of various composition.

Further, the silver halide may contain silver chloride and/or silver iodide as occasion demands.

The finely divided silver halide grains may preferably have an average grain size of 0.01 to 0.3 μm, more preferably 0.02 to 0.2 μm.

The finely divided silver halide grains may be obtained in the same manner as those for preparing an ordinary silver halide emulsion or similarly to the case where an ordinary silver halide emulsion is prepared. In this case, the surface of the grains need not be chemically sensitized and any spectral sensitization need not be made either.

Prior to the addition of the finely divided silver halide grains to a coating solution, a known stabilizer such as a triazole series compound, an azaindene series compound, a benzthiazolium series compound, a mercapto compound, a zinc compound and the like may preferably be added preliminarily thereto.

In cases where two or more layers of the light-insensitive hydrophilic colloidal layers are provided in the light-sensitive silver halide color photographic material according to the present invention, it may be sufficient that at least one layer thereof may be incorporated with the finely divided silver halide grains.

While the amount of the finely divided silver halide grains to be incorporated in the light insensitive hydrophilic colloidal layer in the light sensitive material of the present invention varies depending upon the halogen composition of the finely divided silver halide grains, the bromide ion concentration in a developing solution and a light-sensitive emulsion layer or layers, it may typically be 0.1 to 50 mg/dm$^2$, preferably 1 to 10 mg/dm$^2$ in terms of the amount of silver.

In cases where the finely divided silver halide grains are incorporated in two or more light-insensitive hydrophilic colloidal layer, the total amount thereof may fall within the range as mentioned above. In this case, it is not necessary that the same amount of the finely divided silver halide grains is added to each colloidal layers. If the amount of the finely divided silver halide grains to be added is less than 0.1 mg/dm$^2$, developability can not be promoted sufficiently. If the amount exceeds 50 mg/dm$^2$, the sensitivity is remarkably lowered and a fog density rises, thus causing serious disadvantage to the photographic performance.

The finely divided silver halide grains may be incorporated in any of the light-insensitive hydrophilic colloidal layers. Preferably, however, they may be incorporated in a light-insensitive hydrophilic colloidal layer which is adjacent to the silver halide emulsion layer farthest, when viewed from the support and is located at the opposite side, when viewed from the support, of the silver halide emulsion.

The support used in the light-sensitive material of the present invention includes a flexible reflective support such as a paper laminated with an α-olefin polymer (e.g., polyethylene, polypropylene, ethylene/butene copolymer), a synthetic paper, etc.; a film composed of a semi-synthetic or synthetic polymer such as cellulose acetate, nitro-cellulose, polystyrene, polyvinyl chloride, polyethylene terephthalate, polycarbonate, polyamide, etc.; flexible supports having these films provided with a reflective layer; glass; metal; ceramics; and so on.

The hydrophilic colloidal layer of the light-sensitive material may be coated, after subjecting the surface of the support to corona discharge, irradiation of ultraviolet ray, flame treatment, etc. as occation demands, directly or through at least one subbing layer for improvement of adhesiveness, antistaticity, dimensional stability, antiabrasion, hardness, antihalation, friction property and/or other properties on the surface of the support.

When the light-sensitive material is coated, a thickener may be used to improve the coatability. Further, with respect to such a compound as a film-hardener which causes gelatin before coating if it is preliminarily added to a coating solution due to its high activity, it is preferable to mix such a compound immediately before coating by using a static mixer etc.

As the coating method, there may be particularly useful the extrusion coating method and the curtain coating method capable of coating two or more layers simultaneously.

In order to obtain a dye image by using the light-sensitive material of the present invention, a color photographic processing is carried out after exposure to light. The color processing includes a step of color development, a step of bleaching, a step of fixing, a step of water-washing, and if desired a stabilizing step. In stead of the processing step where a bleaching solution is used and the processing step where a fixing solution is used, a bleach-fixing step may be carried out by using a single bath bleach-fixing solution. There may also be carried out a monobath processing step using a single bath developing-bleaching-fixing solution which can effect the color development, bleaching and fixing in one bath.

By combining these steps of processings, a pre-film-hardening processing step, its neuralization step, a stopping-fixing processing step, a post-film-hardening process step and so on may be carried out.

In these treatment steps, the activator treatment step may be carried out in which a color developing agent or its precursor has been contained in the material and the development processing is carried out with an activator solution, and the activator treatment may be applied to the monobath processing. Among these processings, representative processing procedures will be shown below (In these processing procedures, any one of the water-washing treatment step and the stabilizing processing step is carried out as a final step.

color development—bleach-fixing pre-hardening—color development—stopping-fixing—water-washing—bleaching—fixing—washing—post-hardening color development—washing—complementary color development—stopping—bleaching—fixing activator treatment—bleaching-fixing activator treatment—bleaching-fixing monobath processing The temperature for the processings may be selected as being 10° to 65° C. but may exceed 65° C. Preferably, the processings are carried out at a temperature of 25° to 45° C.

The color developing solution generally comprises a basic aqueous solution containing a color developing agent. The color developing agent is an aromatic primary amine color developing agent, and includes an aminophenol series and p-phenylenediamine series derivatives.

These color developing agent may be used as salts of organic and inorganic acids. For instance, there may be employed hydrochlorides, sulfates, p-toluenesulfonates, sulfites, oxalates, benzenesulfonates and so on.

These compounds may be used generally in a concentration of around 0.1 to 30 g, preferably 1 to 15 g, per one liter of a color developing agent.

The above-mentioned aminophenol type developing agent includes, for example, o-aminophenol, p-aminophenol, 5-amino-2-hydroxytoluene, 2-amino-3-hydroxytoluene, 2-hydroxy-3-amino-1,4-dimethylbenzene.

Especially useful cromatic primary amine series color developing agnets are N,N-dialkyl-p-phenylenediamine series compounds, of which the alkyl group and the phenyl group may be substituted or unsubstituted.

As particularly useful compounds, there may be exemplified N,N-dimethyl-p-phenylendiamine hydrochloride, N-methyl-p-phenylenediamine hydrochloride, N,N-diethyl-p-phenylenediamine hydrochloride, 2-amino-5-(N-ethyl-N-dodecylamino)toluene, N-ehtyl-N-β-methanesulfonamidoethyl-3-methyl-4-aminoaniline sulfate, N-ethyl-N-β-hydroxyaminoethylaminoaniline, 4-amino-3-methyl-N,N-diethylaniline, 4-amino-N-(2-methoxyethyl)-N-ethyl-3-methylaniline p-toluenesulfonate.

Further, the above-mentioned color developing agent may be used in single or in combination of two or more kinds. Furthermore, the above-mentioned color developing agent may be incorporated within the color photographic material. In this case, it is possible to treat the light-sensitive silver halide color photographic material by using a basic solution (activator solution) in place of a color developing solution.

The developing agent may include a basic agent which is usually used for a developing agent, for example, sodium hydroxide, potasium hydroxide, ammonium hydroxide, sodium carbonate, potasium carbonate, sodium sulfate, sodium metaborate or borax. Further, it may contain various additives, for example, benzyl alcohol, alkali metal halide such as potassium bromide and potassium chloride; a develpment regulator such as citrazinic acid; a preservative such as hydroxylamine or a sulfite salt. Further, various anti-foaming agents, surfactants or organic solvent such as methanol, dimethylformamide and dimethyl sulfoxide may optionally be incorporated therein.

The pH value of the color developing agent is typically not less than 7, preferably around 9 to 13.

Further, the color developing agent may be incorporated, as occation demands, with diethylhroxylamine, tetronic acid, tetronimide, 2-amilinoethanol, dihydroxyacetone, aromatic secondary alcohols, hydroxamic acids, pentose or hexose, pyrogallol-1,3-dimethyl ether or a like.

In the color developing agent, there may be used in combination various chelating agents as metalic ion sequestering agent. As the chelating agent, there may be mentioned, for example, an aminopolycarboxylic acid such as ethylenediaminetetraacetic acid and diethylenetriaminepentaacetic acid; an organic phosphonic acid such as 1-hydroxyethylidene-1,1-diphosphonic acid; an aminopolyphosphonic acid such as aminotri(methylene phosphonic acid) and ethylene diamine tetraphosphoric acid; and oxycarboxcic acid such as citric acid and gluconic acid; a phosphonocarboxcic acid such as 2-phosphonobutan-1,2,4-trecarboxylic acid; a polyphosphoric acid such as tripolyphosphoric acid, hexasmetaphosphoric acid; polyhydroxy compounds; and so on.

As stated above, the bleaching step may be carried out simultaneously with or separately from the fixing processing step. As the bleaching agent, there may be employed a metalic complex salt of an organic acid, for example, a polycarboxylic acid, an aminopolycarboxylic acid or an organic acid such as oxalic acid and citric acid which have coordinated a metalic ion such as ion, cobalt and copper. Of the abovementioned organic acids, the most preferred organic acid includes a polycarboxylic acid or aminopolycarboxylic acid. As specific examples of these acids, there may be mentioned ethylenediamine-tetraacetate, diethylenetriaminepentaacetate, ethylenediamine-N-(β-hydroxyehtyl)-N,N',N'-triacetic acid, propylenediaminetetraacetic acid, nitrilotriacetic acid, cyclohexanediamine tetraacetic acid, iminodiacetic acid, dihydroxyethylglycine citric acid (or tartaric acid), ethyletherdiamineteraacetic acid, glycoletherdiamineteraacetic acid, ethylenediamineterapropionic acid, phenylenediamine tetraacetic acid and so on.

These polycarboxylic acids may be in the form of an alkali metal salt, an ammonium salt or a water soluble amine salt.

These bleaching agents may preferably be employed in an amount of 5 to 450 g/l, more preferably 20 to 250 g/l.

In the bleaching solution, there may be employed a solution of composition which contains, other than the above-mentioned bleaching agent, a sulfite salt as a presevative as occation demands. Further, the bleaching solution may contain an ethylenediaminetetraacetatic acid iron [III] complex salt bleaching agent and is a composition containing a large amount of a halide compound such as ammonium bromide. As said halide compounds, there may be employed, in addition to ammonium bromide, hydrogen chloride, hydrogen bromide, lithium bromide, sodium bromide, potassium bromide, sodium iodide, potassium iodide, ammonium iodide and so on.

The bleaching solution used in the present invention may be incorporated with various bleaching acceralators as described in Japanese Provisional Patent Publication (KOKAI) No. 280/1971, Japanese Patent Publication (KOKOKU) Nos. 8506/1970, 556/1971, Belgium Pat. No. 770,910, Japaense Patent Publication (KOKOKU) Nos. 8836/1970 and 9854/1978, Japanese Provisional Patent Publication (KOKAI) Nos. 71634/1979 and 42349/1976, and so on.

The bleaching solution may be employed at a pH of not less than 2.0. Generally, it is used at a pH of 4.0 to 9.5, preferably 4.5 to 8.0, and most preferably 5.0 to 7.0.

For the fixing solution, there may be used any of a composition which has generally been employed in the art. As the fixing agents, there may be employed a compound capable of reacting with such a silver halide as used in an ordinary fixing processing to form a water soluble complex salt. For example, thiosulfate salts such as potasium thiosulfate, sodium thiosulfate, ammonium thiosulfate; thiocyanate salts such as potasium thiocyanate, sodium thiocyanate and ammonium thoiocyanate; thiourea; and thioether are the representatives thereof. While these fixing agents are used in an amount of 5 g/l to the maximum soluble amount, they are generally used in an amount of 70 to 250 g/l. Incidentally, the fixing agent may be incorporated partly in the bleaching solution, reversely, a part of the bleaching agent may be in corporated in the fixing solution.

The bleaching solution and the fixing solution may include various pH buffering agents such as borax, boric acid, sodium hydroxide, potassium hydroxide, sodium carbonate, potasium carbonate, sodium bicarbonate, potassium bicarbonate, acetic acid, sodium acetate, ammonium hydroxide and the like, in single or in combination of two or more kinds thereof. Furthermore, various fluorescent brightening agents and anti-foaming agents or surfactants may be contained therein. Further, there may optionally be incorporated therein a preservative such as hydroxylamine, hydrazine, a bisulfite adduct of an aldehyde compound and the like; an organic chelating agnet such as an aminocarboxylic acid and the like; a stabilizer such as an nitroalcohol, a nitric acid salt and the like; a film hardner such as a water soluble aluminum salt; and organic solvents such as methanol, dimethylsulfoamide, dimethylsulfoxide and the like; and so on.

And the fixing solution may be employed at a pH of not less than 3.0 and generally may be used at a pH of 4.5 to 10, preferably 5 to 9.5, most preferably 6 to 9.

As the bleaching agent to be employed in the bleach-fixing solution, there may be mentioned the metal complex salt of an organic acid as described above in the bleaching processing step. Preferred compound and the concentration thereof in the processing solution are the same as in the above-mentioned bleaching processing step.

As the bleach-fixing solution, there may be employed a solution of composition containing a silver halide fixing agent and optionally a sulfite salt if desired in addition to the above-mentioned bleaching agent. Further, there may also be employed a bleach-fixing solution containing a small amount of an ethylenediaminetetraacetic acid iron [III] complex salt bleaching agent and a halide compound such as ammonium bromide in addition to the above-mentioned silver halide bleaching agent; reversely, a special bleach fixing solution containing a large amount of a halide compound such as ammonium bromide. As the halide compounds, there may be employed, in addition to ammonium bromide, hydrochloric acid, hydrobromic acid, lithium bromide, sodium bromide, potassium bromide, sodium iodide, potassium iodide, ammonium iodide and so on.

As the silver halide fixing agent which may be incorporated in the bleach fixing solution, there may be mentioned the fixing solution as described in connection with the above-mentioned fixing processing step. The concentration of the fixing agent, and the pH buffering agent and other additives which may be corporated in the bleach-fixing solution are the same as in the above-mentioned fixing processing steps. The bleach fixing solution may be employed at a pH of not less than 4.0 and may generally be employed at a pH of 5.0 to 9.5, preferably 6.0 to 8.5 and most preferably 6.5 to 8.5.

Now Examples of this invention will be shown below, but this invention is not limited thereto.

EXAMPLE 1

The test Sample 1 was prepared by applying succesively the following respective layers on a substrate consisting of the subbed cellulose triacetate film from the side of the substrate.

1st layer: An antihalation layer containing black colloidal silver (dry film thickness: 2.5 μm)

2nd layer: An intermediate layer comprising of gelatin (dry film thickness: 1.0 μm)

3rd layer: A low sensitivity red-sensitive silver halide emulsion layer (RL layer)

Silver iodobromide emulsion layer containing 6 mole % of silver iodide (average particle size: 0.5 μm, containing 0.25 mol of the silver halide emulsion and 15 g of gelatin per 500 g of the emulsion) were prepared according to the ordinary method. Chemical sensitization was effected to 500 g of this emulsion with gold and sulfur sensitizers, followed by addition of anhydro-9-ethyl-3,3'-di-(3-sulfopropyl)-4,5,4',5'-dibenzothiacarbocyanine hydroxide, anhydro-5,5'-dichloro-9-ethyl-3,3'-di-(3-sulfopropyl)thiacarbocyanine hydroxide and anhydro-5,5'-dichloro-3',9-diethyl-3-(4-sulfobutyl)oxythiacarbocyanine hydroxide. Then, 0.25 g of 4-hydroxy-6-methyl-1,3,3a,7-tetraazaindene was added thereto. Subsequently, an emulsion was prepared by adding the following dispersion (C-1) to 500 g of this emulsion to apply on the substrate so as to have a dry film thickness of 3.0 μm.

4th layer: A high sensitivity red-color silver halide emulsion layer (RH)

Silver iodobromide emulsion containing 7 mol% of silver iodide (average particle size 0.6 μm: containing 0.25 mol of silver halide and 15 g of gelatin per 500 g of the emulsion) was subjected to chemical sensitization similarly as in the emulsion described above. Further, an emulsifying agent was prepared with addition of 185 ml of the dispersion (C-1) given below to 500 g of this emulsion agent and applied on the substrate so as to have a dry film thickness of 1.5 μm.

5th layer: An intermediate layer which comprises gelatin containing 2,5-di-tert-octylhydroquinone (dry film thickness: 0.8 μm)

6th layer: A low sensitivity green-sensitive silver halide emulsion layer (GL layer)

Silver iodobromide emulsion containing 6 mol% of silver iodide (average particle size 0.5 μm, containing 0.25 mol of silver halide and 20 g of gelatin per 500 g of the emulsion) were prepared according to the ordinary method. Chemical sensitization was effected to 500 g of this emulsion with gold and sulfur sensitizers, followed by addition of anhydro-5,5'-dichloro-9-ethyl-3,3'-di-(3-sulfopropyl)oxacarbocyanine hydroxide, anhydro-5,5'-diphenyl-9-ethyl-3,3'-di-(3-sulfopropyl)oxacarbocyanine and anhydro-9-ethyl-3,3'-di-(3-sulfopropyl)-5,6,5',6'-dibenzoxacarbocyanine hydroxide. Then, 0.25 g of 4-hydroxy-6-methyl-1,3-3a,7-tetraazaindene was added thereto. A low sensitivity green-sensitive silver halide emulsion was prepared by addition of 380 ml of the following dispersion (M-1) to 500 g of this emulsion and applied on the substrate so as to have a dry film thickness of 3.7 μm.

7th layer: A high sensitivity green-sensitive silver halide emulsion layer (GH layer)

Silver iodobromide emulsion containing 7 mol% of silver iodide (average particle size: 0.5 μm, containing 0.25 g of silver halide and 20 g of gelatin per 500 g of the emulsion layer) was subjected to chemical sensitization similarly as in the emulsion described above and a high sensitivity green-sensitive silver halide emulsion (OH-1) by adding the following dispersion (M-1) to 500 g of this emulsion and applied on the substrate so as to have a dry film thickness of 1.5 μm.

8th layer: A gelatin layer containing yellow colloid silver and 2,5-di-tert-octylhydroquinone (dry film thickness: 1.0 μm)

9th layer: A low sensitivity blue-sensitive silver halide emulsion layer (BL layer)

Silver iodobromide emulsion containing 6 mol% of silver iodide (average particle size: 0.5 μm, containing 0.25 mol of silver halide and 40 g of gelatin per 500 g of the emulsion) was prepared by a conventional method, and thereto were added, as sensitizing dyes, anhydrous 5,5'-dimethoxy-3,3'-di-(3-sulfopropyl)thiacyanine and then 0.25 g of 4-hydroxy-6-methyl-1,3,3a,7-tetraazaindene, and a low sensitivity blue-sensitive silver halide emulsion was prepared by addition of 1350 ml of the following dispersion (Y-1) to 500 g of this emulsion and then applied on the substrate so as to have a dry film thickness of 3.0 μm.

10th layer: A high sensitivity blue-sensitive silver halide emulsion layer (BH layer)

Silver iodobromide emulsion containing 7 mol% of silver iodide (average particle size: 0.8 μm, containing 0.25 mol of silver halide and 40 g of gelatin per 500 g of the emulsion) was subjected to chemical sensitization and a high sensitivity blue-sensitive silver halide emulsion was prepared by addition of 550 μm of the following dispersion (Y-1) to 500 g of this emulsion layer and then applied on the substrate so as to have 2.0 μm.

11th layer: An intermediate layer comprising gelatin containing a UV absorber (dry film thickness: 1.2 μm)

12th layer: A protective layer comprising gelatin containing a matting agent (dry film thickness: 0.7 μm)

Dispersion (C-1)

30 g of Coupler 1 and 3.0 g of Coupler 2 given below were dissolved in a mixture of 33 g of tricresyl phosphate (TCP) and 198 g of ethyl acetate (EA). The resulting solution was added to 440 ml of a 10% aqueous solution of gelatin which contains 2.0 g of sodium triisopropylnaphthalene sulfonate (SUR—1) and adjusted the emulsion to 1,000 ml by dispersing in a colloid mill.

Dispersion (M-1)

A dispersion (M-1) having the following formulation was prepared according to the similar procedure used for preparing the dispersion (C-1).

| | |
|---|---|
| Coupler 3 | 40.0 g |
| Coupler 4 | 8.0 g |
| TCP | 48 g |
| EA | 145 g |
| 10% gelatin | 400 ml |
| SUR-1 | 4.5 g |
| Made up to 1000 ml | |

Dispersion (Y-1)

A dispersion (Y-1) having the following formulation was prepared according to the similar procedure used for preparing the dispersion (C-1).

| | |
|---|---|
| Coupler 5 | 50.0 g |
| TCP | 5.0 g |
| EA | 165 g |
| 10% gelatin | 370 ml |
| SUR-1 | 4.0 g |
| Made up to 1000 ml | |

Sample 1 was prepared as mentioned above. Further, Sample 2 to 9 were prepared by substituting the dispersion (C-1) in the third layer of the Sample 1 with the respective dispersions shown in Table 1 below or newly adding the dye dispersions.

TABLE 1

| Test Sample No. | Dispersion used instead of (C-1) in the 3rd layer of test sample no. 1, DIR compounds added thereto | Dye dispersion: No. of dispersion amount added (ml) | Dye dispersion: Additive containing layer |
|---|---|---|---|
| 1 | — | — | — |
| 2 | (C-2), D-55 | — | — |
| 3 | (C-3), comparative DIR compound | (Dye-1) 25 | 12th layer |
| 4 | (C-4), D-40 | (Dye-1) 25 | " |
| 5 | (C-2), D-55 | (Dye-1) 25 | " |
| 6 | (C-4), D-40 | (Dye-1) 25 | 5th layer |
| 7 | (C-2), D-55 | (Dye-1) 25 | " |
| 8 | " | (Dye-2) 30 | " |
| 9 | " | (Dye-3) 20 | " |
| 17 | " | (Dye-7) 30 | " |

Dispersion (C-2)

A dispersion was prepared by dispersing similarly as in preparation of Dispersion (C-1) except that 1.4 g of the diffusible DIR compounds (D-55) was added thereto.

Dispersion (C-3)

A dispersion was prepared by dispersing similarly as in preparation of Dispersion (C-1) except that 1.1 g of the comparative DIR compound (1) was added thereto.

Dispersion (C-4)

A dispersion was prepared by dispersing similarly as in preparation of Dispersion (C-1) except that 1.2 g of the diffusible DIR compound (C-40) was added thereto.

Dispersion (Dye 1)

30 g of the non-diffusible dye of this invention (A-17) was dissolved in a mixture of 15 g of tricresyl phosphate (TCP) and 90 g of ethyl acetate (EA). The resulting solution was added to 450 ml of a 10% aqueous gelation solution containing 5.0 g of sodium triisopropylnaphthalene sulfonate and emulsifyingly dispersed by means of a colloid mill to prepare 1000 ml of the dispersion.

Dispersion (Dye 2)

A dispersion was prepared by dispersing similarly as in preparation of Dispersion (Dye-1) except that the non-diffusive dye (A-17) of Dispersion (Dye-1) was replaced by (A-3).

Dispersion (Dye 3)

A dispersion was prepared by dispersing similarly as in preparation of Dispersion (Dye-1) except that the non-diffusible dye (A-17) of Dispersion (Dye-1) was replaced by (A-3).

[Compounds used for preparing Samples 1 to 9]

Coupler 1
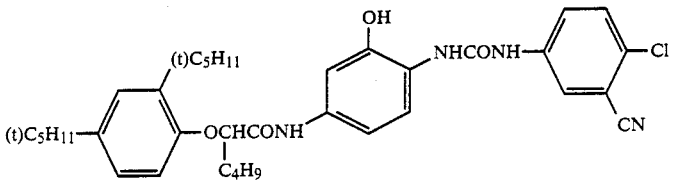
Coupler 2
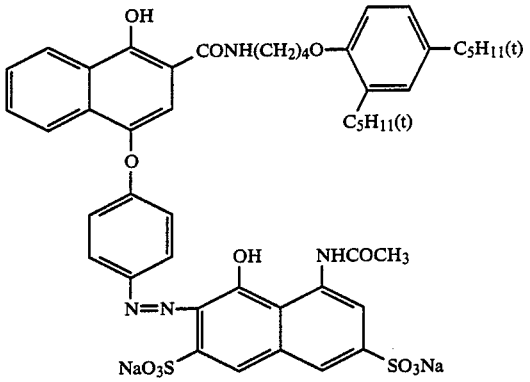
Coupler 3
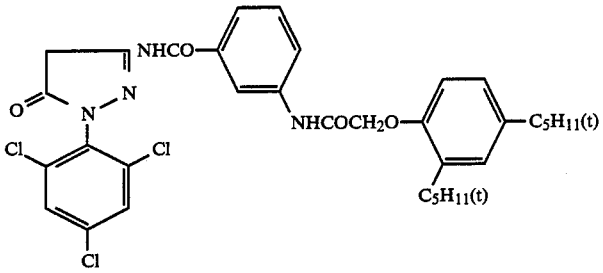
Coupler 4
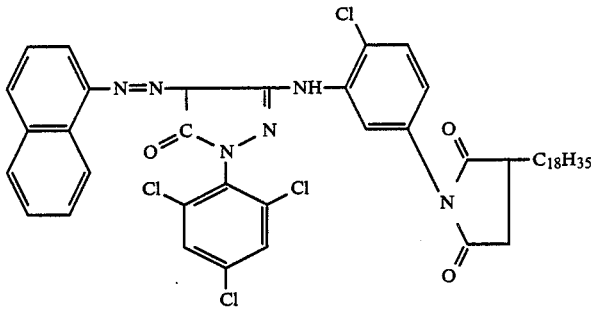
Coupler 5
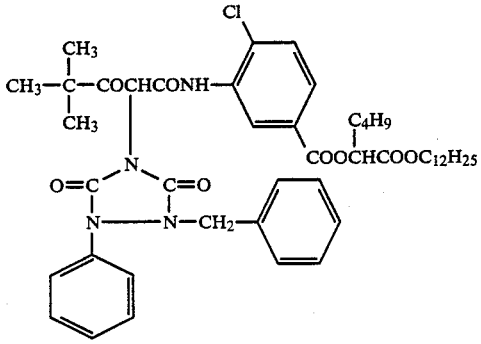

-continued

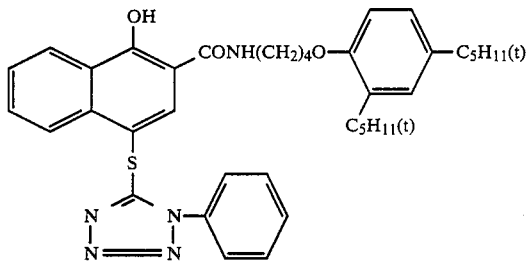

Comparative DIR compound

These samples were treated according to the following processing steps after subjecting the samples to the white light exposure through a wedge, respectively.

Developing processing step (38° C.) processing time

| | | |
|---|---|---|
| Color developing | 3 minutes | 15 seconds |
| Bleaching | 6 minutes | 30 seconds |
| Washing with water | 3 minutes | 15 seconds |
| Fixing | 6 minutes | 30 seconds |
| Washing | 3 minutes | 15 seconds |
| Stabilizing | 1 minutes | 30 seconds |

The formulation of the processing solution used in each processing step is as follows.

Composition of the color developing solution:

| | |
|---|---|
| 4-Amino-3-methyl-N—ethyl-N(B—hydroxyethyl)aniline sulfate | 4.8 g |
| Anhydrous sodium sulfite | 0.14 g |
| Hydroxylamine ½-sulfate | 1.98 g |
| Sulfuric acid | 0.74 g |
| Anhydrous potassium carbonate | 28.85 g |
| Anhydrous potassium hydrogen-carbonate | 3.46 g |
| Anhydrous potassium sulfite | 5.10 g |
| Potassium bromide | 1.16 g |
| Sodium chloride | 0.14 g |
| Trisodium nitrirotriacetate (monohydrate) | 1.20 g |
| Potassium hydroxide | 1.48 g |
| made up to one liter with addition of water. | |

These samples were treated according to the following processing steps after subjecting the samples to the white light exposure through wedge, respectively.

Developing processing step (38° C.) processing time

| | | |
|---|---|---|
| Color developing | 3 minutes | 15 seconds |
| Bleaching | 6 minutes | 30 seconds |
| Washing with water | 3 minutes | 15 seconds |
| Fixing | 6 minutes | 30 seconds |
| Washing | 3 minutes | 15 seconds |
| Stabilizing | 1 minutes | 30 seconds |

The formulation of the processing solution used in each processing step was as follows.

Composition of the color developing solution:

| | |
|---|---|
| 4-Amino-3-methyl-N—ethyl-N(B—hydroxyethyl)aniline sulfate | 4.8 g |
| Anhydrous sodium sulfite | 0.14 g |
| Hydroxylamine ½-sulfate | 1.98 g |

-continued

| | |
|---|---|
| Sulfuric acid | 0.74 g |
| Anhydrous potassium carbonate | 28.85 g |
| Anhydrous potassium hydrogen-carbonate | 3.46 g |
| Anhydrous potassium sulfite | 5.10 g |
| Potassium bromide | 1.16 g |
| Sodium chloride | 0.14 g |
| Trisodium nitrirotriacetate (monohydrate) | 1.20 g |
| Potassium hydroxide | 1.48 g |
| made up to one liter with addition of water. | |

The formulation of the bleaching solution:

| | |
|---|---|
| Diammonium ethylenediaminetetraacetate iron | 100.0 g |
| Ethylenediaminetetraacetate | 10.0 g |
| Ammonium bromide | 150.0 g |
| Glacial acetic acid | 10.0 ml |
| made up to 1 liter with addition of water and adjusted to pH 6.0 with aqueous anmonia | |

The formulation of the filixng solution:

| | |
|---|---|
| Ammonium thiosulfate | 175.0 g |
| Anhydrous sodium sulfite | 8.6 g |
| Sodium metasulfite | 2.3 g |
| made up to 1 liter with addition of water and adjusted to pH 6.0 with acetic acid. | |

The formulation of the stabilizing solution:

| | |
|---|---|
| Fomalin (37% aqueous solution) | 1.5 g |
| KONIDAX (produced by Konishiroku Photo Ind. Co., Ltd.) (made up to 1 liter with addition of water) | 7.5 ml |

Next, the sensitivity and sharpness of the color images formed in using each Sample were determined. The results are shown in Table 2.

Sensitivities were represented relative to the sensitivity of the cyan image of Sample 1 exposed to the white light as 100, and sharpness of the image was evaluated by determining MTF (Modulation Transfer Function) and space frequencies at MTF of 90% and 50%. It is indicated that the more the space frequencies at both low frequency area (image resolving power at 90% MFT) and high frequency area (image resolving power at 50% MTF) may be, the better the sharpness may be obtained.

TABLE 2

| Sample No. | Dye: Compounds | Dye: Additive containing layer | Diffusive DIR compounds: Kind | Diffusive DIR compounds: Additive containing layer | Relative Sensitivity Red color sensitivity | Sharpness (MTF): Image resolving 90% MTF (line/mm) | Sharpness (MTF): Image resolving 50% MTF (line/mm) |
|---|---|---|---|---|---|---|---|
| 1 (Control) | — | — | — | — | 100 | 9.0 | 21.0 |
| 2 (Control) | — | — | D-55 | 3rd layer | 95 | 10.5 | 24.0 |
| 3 (Control) | A-17 | 12th layer | Comparative DIR compound | 3rd layer | 83 | 10.7 | 24.8 |
| 4 (This invention) | A-17 | 12th layer | D-40 | 3rd layer | 82 | 13.5 | 32.0 |
| 5 (This invention) | A-17 | 12th layer | D-55 | 3rd layer | 83 | 16.2 | 38.0 |
| 6 (This invention) | A-17 | 5th layer | D-40 | 3rd layer | 82 | 16.0 | 38.5 |
| 7 (This invention) | A-17 | 5th layer | D-55 | 3rd layer | 85 | 18.2 | 42.0 |
| 8 (This invention) | A-3 | 5th layer | D-55 | 3rd layer | 83 | 17.9 | 41.0 |
| 9 (This invention) | A-39 | 5th layer | D-55 | 3rd layer | 80 | 17.1 | 40.0 |
| 17 (This invention) | A-5 | 5th layer | D-55 | 3rd layer | 83 | 18.0 | 42.0 |

As is apparent from Table 2, the improvement effects of the sharpness at both low frequency area and high frequency area according to this invention (Samples 4 to 9) are remarkable.

It can be found that the improvement is more effective is more effective by adding the non-diffusive dyes to the non-light-sensitive hydrophilic colloid layer adjacent to the red-sensitive layer (5th layer) than by adding to the most upper layer (12th layer) in the comparison of this invention.

Also, visible evaluation was carried out concerning the color reproducibility by cutting the above Sam-Samples 1 to 9 in 35 mm width, placing into cameras, taking photographs of the same sheets and preparing the prints. As the result, there could be obtained prints clear in the pure colors, particularly red color when using the present Samples 4 to 9.

Further, 2 mg/dm$^2$ of silver iodobromide (AgBr: 96 mole%) having an average grain size of 0.08 μm was added to the 11th layer of a sample prepared in the same manner as in Sample No. 7. As the result, the relative red sensitivity was 102 and the MTF value was almost the same as in Sample No. 7.

Samples were prepared in the same manner as in Samples No. 4 to No. 9 except that each silver halide emulsion at the 4th layer was replaced by a table silver halide emulsion in which the average grain size of the silver halide grains is 1.12 μm; the average silver iodide content was 8 mole% the content at the central portion of silver iodide was 15 mole % and the average aspect ratio of 7.

As the result, the relative red sensitivity was around 110 and the MIF value was almost the same as in Samples No. 4–No. 9.

EXAMPLE 2

Sample 10 was prepared by applying successively the following respective layers on the substrate made of subbed cellulose triacetate film from the substrate.

1st layer: A halation preventing layer containing black colloidal silver (dry film thickness: 2.0 μm)

2nd layer: An intermediate layer of gelatin (dry film thickness: 1.0 μm)

3rd layer: A low sensitivity red-sensitive siler halide emulsion layer (RL layer)

The same emulsion described in the 3rd layer of the Sample 1 of Example 1 was applied to the substrate so as to have a dry film thickness of 3.5 μm.

4th layer: An intermediate layer consisting of gelatin containing 2,5-di-tert-octylhydroquinone (dry film thickness: 0.8 μm)

5th layer: A low sensitivity green-sensitive silver halide emulsion layer (GL layer)

The same emulsion as described in the 6th layer of the Sample 1 of Example 1 was applied on the substrate so as to have a dry film thickness of 3.0 μm.

6th layer: An intermediate layer same as the 4th layer (dry film thickness: 0.8 μm)

7th layer: A low sensitivity blue-sensitive silver halide emulsion layer (BL layer)

Using silver iodobromide emulsion containing 5 mol% silver iodide (average particle size: 0.7 μm, containing 0.25 mol of silver halide and 40 g of gelatin per 500 g of the emulsion), the substrate was coated similarly as in the 9th layer of Sample 9 of Example 1 (dry film thickness: 3.0 μm).

8th layer: An intermediate layer same as the 4th layer (dry film thickness: 0.8 μm)

9th layer: A high sensitivity red-sensitive silver halide emulsion layer (RH layer)

Using the Dispersion (C-5) instead of the Dispersion (C-1), the same emulsion as described in the 4th layer of Example 1 was applied on the substrate so as to have a dry film thickness of 1.5 μm.

10th layer: An intermediate layer same as the 4th layer (dry film thickness: 0.8 μm)

11th layer: A high sensitivity green-sensitive silver halide emulsion layer (GH layer)

The same emulsion as described in the 7th layer of the Sample 1 of Example 1 was applied on the substrate so as to have a dry film thickness of 1.5 μm.

12th layer: A gelatin layer containing yellow colloidal silver and 2,5-di-tert-octylhydroquinone (dry film thickness: 1.0 μm)

13th layer: A high sensitivity blue-sensitive silver halide emulsion layer (BH layer)

The same emulsion as described in the 10th layer of Samples 1 of Example 1 was applied on the substrate so as to have a dry film thickness of 1.5 μm.

14th layer: An intermediate layer consisting of gelatin containing a UV absorber (dry film thickness: 1.2 μm)

15th layer: A protective layer consisting of gelatin containing a matting agent (dry film thickness: 0.7 μm)

Dispersion (C-4)

| | |
|---|---|
| Coupler-1 | 30 g |
| TCP | 33 g |
| EA | 198 g |
| 10% Gel | 440 ml |
| SUR-1 | 2.0 g |
| made up to 1000 ml | |

Sample 10 was prepared as described above. Further, Samples 11 to 16 were prepared by replacing the coupler dispersion as shown in the following Table 3 or adding newly dye dispersions.

Dispersion (M-2)

The dispersion was prepared by dispersing similarly as in Dispersion (M-1) except for adding 1.8 g of diffusible DIR compound (D-56).

Dispersion (M-3)

The dispersion was prepared by dispersing similarly as in Dispersion (M-1) except for adding 1.4 g of diffusible DIR compound (D-62).

Dispersion (Dye-4)

The dispersion was prepared by dispersing similarly as in Dispersion (Dye 1) except that non-diffusible dye (A-17) of Dispersion (Dye-1) was replaced with A-4.

Dispersion (Dye-5)

The dispersion was prepared by dispersing similarly as in Dispersion (Dye 1) except that non-diffusible dye (A-17) of Dispersion (Dye-1) was replaced with A-13.

TABLE 3

| Sample No. | Red color absorbing dye: No. of dispersion amount added (ml) | Red color absorbing dye: Additive-nontaining layer | Green color absorbing dye: No. of dispersion amount added (ml) | Green color absorbing dye: Additive-containing layer | No. of dispersion to be used as the coupler of 3rd layer, DIR compound added there to | No. of dispersion to be used as the coupler of 5th layer DIR compound added there to |
|---|---|---|---|---|---|---|
| 10 | — | — | — | — | (C-1) | (M-1) |
| 11 | Dye-1 20 | 15th layer | Dye-5 25 | 15th layer | " | " |
| 12 | Dye-1 20 | 15th layer | Dye-5 25 | 15th layer | (C-5),D-59 | (M-2),D-56 |
| 13 | Dye-1 20 | 15th layer | Dye-5 25 | 6th layer | (C-5),D-59 | (M-2),D-56 |
| 14 | Dye-1 20 | 4th layer | Dye-5 25 | 6th layer | (C-5),D-59 | (M-2),D-56 |
| 15 | Dye-1 20 | 4th layer | Dye-5 25 | 6th layer | (C-6),D-62 | (M-3),D-62 |
| 16 | Dye-4 25 | 4th layer | Dye-6 30 | 6th layer | | |

Dispersion (C-5)

The dispersion was prepared by dispersing similarly as in Dispersion (C-1) except for adding 1.2 g of diffusible DIR compound (D-59).

Dispersion (C-6)

The dispersion was prepared by dispersing similarly as in Dispersion (C-1) except for adding 1.4 g of diffusible DIR compound (D-62).

Dispersion (Dye-6)

The dispersion was prepared by dispersing similarly as in Dispersion (Dye 1) except that non-diffusible dye (A-17) of Dispersion (Dye-1) was replaced with A-1.

The developing processing was performed similarly as in Example 1 after subjecting these samples to white light exposure through wedges. Then, the sensitivity and sharpness of the color image formed on each sample were determined by similar procedure as used in Example 1. The optical densities of the filter layers to which the dyes were added was 0.05 as the red color density in the red color absorbing dye filter layer and 0.06 as the green color density in the green color absorptive dye filter layter. The results are shown in Table 4.

TABLE 4

| Sample No. | Red color Absorbing dye: Compounds | Red color Absorbing dye: Additive containing layer | Green color Absorbing dye: Compounds | Green color Absorbing dye: Additive containing layer | Diffusible DIR Compound: 3rd layer | Diffusible DIR Compound: 5th layer | Red color sensitive: Relative sensitivity | Red color sensitive: Image resolving power of 90% MTF (line/mm) | Green color sensitive: Relative sensitivity | Green color sensitive: Image Resolving Power of 90% MTF (line/mm) |
|---|---|---|---|---|---|---|---|---|---|---|
| 10 (Control) | — | — | — | — | — | — | 100 | 8.5 | 100 | 15.0 |
| 11 (Control) | A-17 | 15th layer | A-13 | 15th layer | — | — | 80 | 9.2 | 81 | 16.5 |
| 12 (This invention) | A-17 | 15th layer | A-13 | 15th layer | D-59 | D-56 | 81 | 12.8 | 82 | 23.0 |

TABLE 4-continued

| Sample No. | Red color Absorbing dye Compounds | Red color Absorbing dye Additive containing layer | Green color Absorbing dye Compounds | Green color Absorbing dye Additive containing layer | Diffusible DIR Compound 3rd layer | Diffusible DIR Compound 5th layer | Red color sensitive Relative sensitivity | Red color sensitive Image resolving power of 90% MTF (line/mm) | Green color sensitive Relative sensitivity | Green color sensitive Image Resolving Power of 90% MTF (line/mm) |
|---|---|---|---|---|---|---|---|---|---|---|
| 13 (This invention) | A-17 | 15th layer | A-13 | 6th layer | D-59 | D-56 | 80 | 12.5 | 85 | 28.0 |
| 14 (This invention) | A-17 | 4th layer | A-13 | 6th layer | D-59 | D-56 | 85 | 16.1 | 86 | 28.5 |
| 15 (This invention) | A-17 | 4th layer | A-13 | 6th layer | D-62 | D-62 | 86 | 16.3 | 84 | 28.4 |
| 16 (This invention) | A-4 | 4th layer | A-1 | 6th layer | D-62 | D-62 | 82 | 16.5 | 80 | 27.9 |

From Table 4, it is evident that samples (test Samples 12 to 16) according to this invention are remarkably improved in the sharpness. Further, the color reproducibility was visibly evaluated by taking photographies using Samples 10 to 16 by means of a camera and preparing the prints by the similar method as in Example 1. As the results, the pure colors, particularly green and red colors, could be reproduced clearly in cases where Samples 12 to 16 according to this invention were used.

What is claimed is:

1. A light-sensitive silver halide color photographic material comprising a support, a red sensitive emulsion group having at least two layers with color sensitivities which are substantially the same and different light sensitivities, a first of said red sensitive layers being disposed closer to the support than all other of the red sensitive layers, a green sensitive emulsion group having at least two layers with color sensitivities which are substantially the same and different light sensitivities, a first of said green sensitive layers being disposed closer to said support than all other green sensitive layers; and a plurality of light-insensitive hydrophilic colloidal layers;

a DIR compound, or precursor thereof by reaction with an oxidized form of a color developing agent, being contained in at least one of said red sensitive emulsion layers, said green sensitive emulsion layers and said light-insensitive hydrophilic colloidal layers; and wherein either:

A. at least one layer of said light insensitive hydrophilic colloidal layers contains a non-diffusible red absorptive dye and is located further from the support than said first red sensitive layer; or B. at least one layer of said light sensitive hydrophilic colloidal layers contains a non-diffusible green absorptive dye and is located further from the support than said first green sensitive layer; or both conditions A and B.

2. The light-sensitive silver halide color photographic material according to claim 1, wherein the light-insensitive hydrophilic colloidal layer containing the non-diffusible red absorptive dye is located at the position being adjacent to and further, when viewed from the support, than any of the red sensitive emulsion layers.

3. The light-sensitive silver halide color photographic material according to claim 1, wherein the light-insensitive hydrophilic colloidal layer containing the non-diffusible green absorptive dye is located at the position being adjacent to and further when viewed from the support, than any of the green sensitive emulsion layers.

4. The light-sensitive silver halide color photographic material according to claim 2, wherein the light-insensitive hydrophilic colloidal layer containing the non-diffusible red absorptive dye is located at the position being adjacent to and further, when viewed from the support, than the red sensitive emulsion layer furthest from the support.

5. The light-sensitive siliver halide color photographic material according to claim 3, wherein the light-insensitive hydrophilic colloidal layer containing the non-diffusible green absorptive dye is located at the position being adjacent to and further, when viewed from the support, than the green sensitive emulsion layer furthest from the support.

6. The light-sensitive silver halide color photographic material according to claim 1, wherein said DIR compound is contained in at least one layer of the red sensitive emulsion layers and the green sensitive emulsion layers.

7. The light-sensitive silver halide color photographic material according to claim 1, wherein said DIR compound is contained in a layer or layers other than the most sensitive layer in case when said at least two red or green sensitive emulsion layers have substantially the same color sensitivity and different light-sensitivities.

8. The light-sensitive silver halide color photographic material according to claim 1, wherein said DIR compound is contained in at least one layer of the red sensitive emulsion layers and the green sensitive emulsion layers; and wherein the light-insensitive hydrophilic colloidal layer containing the non-diffusible red absorptive dye is located at the position being adjacent to and further, when viewed from the support, than any of the red sensitive emulsion layers, or the light-insensitive hydrophilic colloidal layer containing the non-diffusible green absorptive dye is located at the position being adjacent to and further when viewed from the support, than any of the green sensitive emulsion layers.

9. The light-sensitive silver halide color photographic material according to claim 1, wherein said DIR compound is contained in a layer or layers other than the most sensitive layer in case when said at least two red or green sensitive emulsion layers have substantially the same color sensitivity and different light-sensitivities; and wherein the light-insensitive hydrophilic colloidal layer containing the non-diffusible red absorptive dye is located at the position being adjacent to and further, when viewed from the support, than any of the red sensitive emulsion layers or the light-insensitive hydrophilic colloidal layer containing the non-diffusible green absorptive dye is located at the position being adjacent to and further when viewed from the support, than any of the green sensitive emulsion layers.

10. The light-sensitive silver halide color photographic material according to claim 1, wherein the DIR compound is represented by the following general formula (1):

$$A(Y)m \quad (1)$$

wherein A represents a coupler component; m is an integer of 1 or 2, and Y is a group which is bonded to the coupler component A at the coupling site of A and capable of being eliminated by the reaction of the DIR compound with an oxidized form of a color developing agent to become, after eliminated, a development inhibitor having higher diffusibility or a compound capable of releasing a development inhibitor.

11. The light-sensitive silver halide color photographic material according to claim 10 wherein Y is general formula (1) is a group selected from the groups of the general formula (2A) to (5)

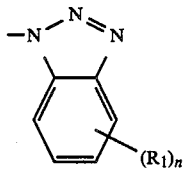
general formula (2A)

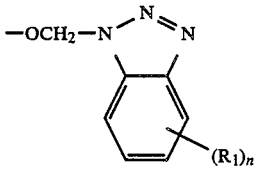
general formula (2B)

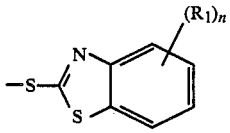
general formula (2C)

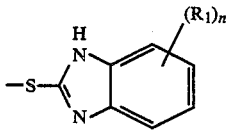
general formula (2D)

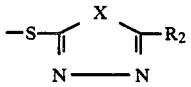
general formula (2E)

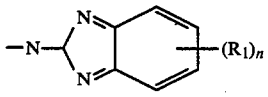
general formula (3)

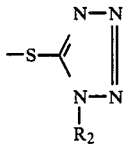
general formula (4)

-continued

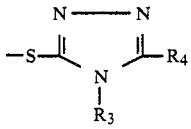
general formula (5)

wherein, in general formulas (2A)–(2D) and (3), $R_1$ represents an alkyl group, an alkoxy group, an acylamino group, a halogen atom, an alkoxycarbonyl group, a thiazolideneamino group, an aryloxycarbonyl group, an acyloxy group, a carbamoyl group, an N-alkylcarbamoyl group, an N,N-dialkylcarbamoyl group, a nitro group, an amino gorup, an N-arylcarbamoyloxy group, a sulfamoyl group, an N-alkylcarbamoyloxy gorup, a hydroxy group, an alkoxycabonylamino group, an alkylthio group, an arylthio group, an aryl group, a heterocyclic group, a cyano group, an alkylsulfonyl group or an aryloxycarbonylamino group; n represents 1 or 2 and, in cases where n is 2, $R_1$ may be the same or different and the total number of carbon atoms included in n $R_1$s is 0 to 10; $R_2$ in general formula (2E) has the same meaning as $R_1$ of (2A)–(2D) and X represents an oxygen atom or a sulfur atom; $R_2$ represents an alkyl group, an aryl group or a heterocyclic group in general formula (4); $R_3$ represents a hydrogen atom, an alkyl group, an aryl group or a heterocyclic group, and $R_4$ in general formula (5) represents a hydrogen atom, an alkyl group, an aryl group, a halogen atom, an acylamino group, an alkoxycarbonylamino group, an aryloxycarbonylamino group, an alkanesulfonamido group, a cyano group, a heterocyclic group, an alkylthio group or an amino group; provided that in general formula (2E) and (4), the number of carbon atoms contained in $R_2$ is 1 to 15; and in general formula (5), the total number of carbon atoms contained in $R_3$ and $R_4$ is 1 to 15.

12. The light-sensitive silver halide color photographic material according to claim 10 wherein Y in general formula (1) is a group represented by the following general formula (6)

$$\text{—TIME—INHIBIT} \quad (6)$$

wherein TIME represents a group bonded to the coupling site of a coupler, capable of being cleaved by the reaction with a color developing agent and capable of releasing, after cleavage, and INHIBIT group under appropriate control; an INHIBIT represents a group which functions as a development inhibitor after released.

13. The light-sensitive silver halide color photographic material according to claim 12 wherein the —TIME-INHIBIT group is a group selected from the groups represented by the following general formulas (7)–(13)

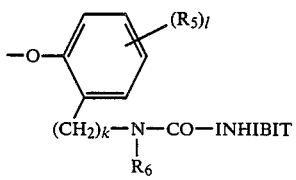
general formula (7)

-continued general formula (8)

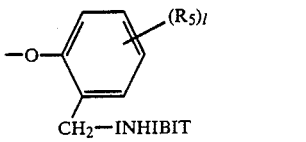

general formula (9)

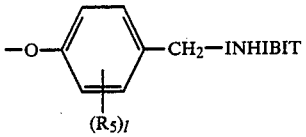

general formula (10)

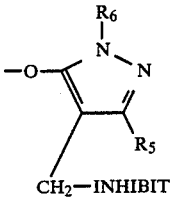

general formula (11)

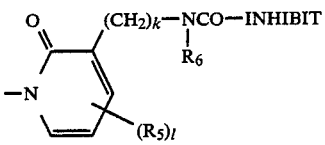

general formula (12)

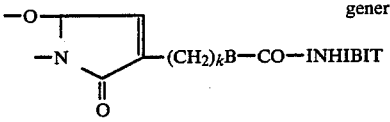

general formula (13)

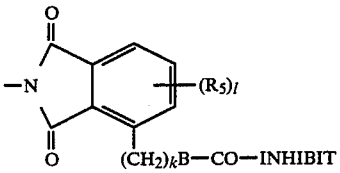

wherein, in general formulas (7) to (13), $R_5$ represents a hydrogen atom, a halogen atom, an alkyl group, an alkenyl group, an aralkyl group, an alkoxy brouop, an alkoxy-carbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group or an alkanesulfonyl group; in general formulas (7), (8), (9), (11) and (13), l represents an integer of 1 or 2; in general formulas (7), (11), (12) and (13), k represents an integer of 1 or 2; in general formulas (7), (10) and (11), $R_6$ represents an alkyl group, an alkenyl group, an aralkyl group, a cycloalkyl group or an aryl group; in general formulas (12) and (13), B represents an oxygen atom or a

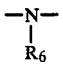

group in which $R_6$ has the same meanings as defined above; and INHIBIT has the same meanings as defined in general formulas (2A), (2B), (3), (4) and (5), provided that, in general formula (2A), (2B) and (3), the number of carbon atoms contained in each of $R_1$ in molecule is 1 to 32 in total; in general formula (4), the number of carbon atoms contained in $R_2$ is 1 to 32; and, in general formula (5), the number of carbon atoms contained in $R_3$ and $R_4$ is 0 to 32 in total.

14. The light-sensitive silver halide color photographic material according to claim 10 wherein A in general formula (1) represents a residue selected from a yellow coupler residue of the pivaloyacetanilide type, the benzolylacetanilide type, the malonic acid diester type, the malonic acid diamide type, dibenzoylmethane type, the benzothiazolylacetamide type, the malonic acid monoester monoamide type, the benzothiazolyl acetate type, the benzoxazolylacetamide type, the benzoxazolyl acetate type, the benzimidazolylacetamide type or the benzimidazolyl acetate type; a magenta coupler residue having a 5-oxo-2-pyrazoline nucleus, a pyrazolo-[1,5-a]benzimidazole nucleus or a cyanoacetophenone type coupler residue; a cyan coupler residue having a phenol nucleus or an α-naphthol residue, or a coupler residue of an imidazolone series or a pyrazolotriazole series.

15. The light-sensitive silver halide color photographic material according to claim 1 wherein the amount of the DIR compound to be used is within a range of 0.0005 to 0.05 mole per one mole of the silver halide contained in an emulsion layer.

16. The light-sensitive silver halide color photographic material according to claim 15 wherein the amount of the DIR compound to be used in within a range of 0.001 to 0.01 mole per one mole of the silver halide contained in an emulsion layer.

17. The light-sensitive silver halide color photographic material according to claim 1 wherein the amount of the non-diffusible red or green absorptive dye to be used in such that the transmission density is 0.01 to 0.3 when measured with a light of wave length region corresponding to the color sensitivity in the red region (600 to 700 nm) or the green region (500 to 600 nm) for the red or green absorptive light-insensitive hydrophilic colloidal layer containing the red or green absorptive dye, repectively.

18. The light-sensitive silver halide color photographic material according to claim 17 wherein the amount of the non-diffusible red or green absorptive dye to be used is such that the transmission density is 0.03 to 0.1.

19. The light-sensitive silver halide color photographic material according to claim 2 wherein the light-insensitive hydrophilic colloidal layer containing the non-diffusible red absorptive dye is located at the position being adjacent to and farther, when viewed from the support, than the red sensitive emulsion layer closest to the support.

20. The light-sensitive silver halide color photographic material according to claim 3 wherein the light-insensitive hydrophilic colloidal layer containing the non-diffusible green adsorptive dye is located at the position being adjacent to and farther, when viewed from he support, than the green sensitive emulsion layer closest to the support.

21. The light-sensitive silver halide color photographic material according to claim 1, wherein said non-diffusible red absorptive dye is a reaction product of a cyan coupler with a color developing agent.

22. The light-sensitive silver halide color photographic material according to claim 1, wherein said non-diffusible green absorptive dye is a reaction product of a magenta coupler with a color developing agent.

23. The light-sensitive silver halide color photographic material according to claim 1, wherein the non-diffusible green absorptive dye is a colored cyan coupler.

24. The light-sensitive silver halide color photographic material according to claim 1, wherein at least one layer of said light-insensitive hydrophilic colloidal layers is incorporated with finely divided silver halide.

25. The light-sensitive silver halide color photographic material according to claim 1, wherein said silver halide contained in the emulsion is tablet silver halide grains.

26. The light-sensitive silver halide color photographic material according to claim 25, wherein the average aspect ratio of the tablet silver halide grains is 5 or higher.

27. The light-sensitive silver halide color photographic material according to claim 23, wherein said colored cyan coupler is a compound represented by the following general formula [I]-a or [I]-b

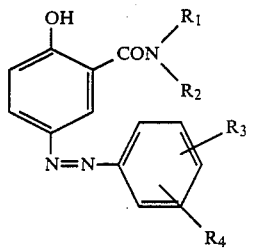

general formula [I] - a

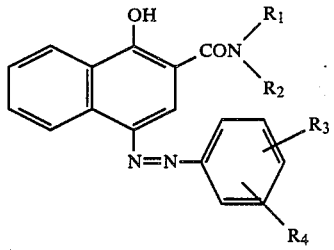

general formula [I] - b wherein $R_1$ and $R_2$ represent, independently of each other, a hydrogen atom, a straight-chain or branched alkyl group having 1 to 30 carbon atoms, a mono- or bicycloalkyl group, a terpenyl group, an aryl group, a heterocyclic group, or $R_1$ and $R_2$ may represent non-matallic atoms necessary for forming, together with the nitrogen atom to which they are attached, a heterocyclic group.

* * * * *

UNITED STATES PATENT AND TRADEMARK OFFICE

CERTIFICATE OF CORRECTION

PATENT NO. : 4,746,600

DATED : May 24, 1988

INVENTOR(S) : WATANABE et al

It is certified that error appears in the above-identified patent and that said Letters Patent is hereby corrected as shown below:

Column 85, line 44 (claim 1):

Replace "a DIR compound, or precursor thereof" with --a DIR compound capable of releasing a diffusible development inhibitor or a precursor thereof--.

Column 85, lines 54-55 (claim 1):

Replace "light sensitive hydrophilic colloidal layers" with --light insensitive hydrophilic colloidal layers--.

Signed and Sealed this

Seventh Day of April, 1992

*Attest:*

HARRY F. MANBECK, JR.

*Attesting Officer*

*Commissioner of Patents and Trademarks*